US007753775B2

(12) United States Patent
Yoshizawa

(10) Patent No.: US 7,753,775 B2
(45) Date of Patent: Jul. 13, 2010

(54) GAMING MACHINE AND GAMING SYSTEM

(75) Inventor: Kazumasa Yoshizawa, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 836 days.

(21) Appl. No.: 11/544,012

(22) Filed: Oct. 6, 2006

(65) Prior Publication Data

US 2007/0191089 A1 Aug. 16, 2007

(30) Foreign Application Priority Data

Oct. 7, 2005 (JP) ..... 2005-294599

(51) Int. Cl.
*A63F 9/00* (2006.01)

(52) U.S. Cl. ..... 463/20

(58) Field of Classification Search ..... 463/20
See application file for complete search history.

(56) References Cited

U.S. PATENT DOCUMENTS 4,844,464 A * 7/1989 Berge ..... 463/27
5,016,880 A * 5/1991 Berge ..... 463/27
5,178,390 A * 1/1993 Okada ..... 273/143 R
5,941,773 A * 8/1999 Harlick ..... 463/26
6,113,492 A * 9/2000 Walker et al. ..... 463/16
6,113,493 A * 9/2000 Walker et al. ..... 463/25
6,270,409 B1 * 8/2001 Shuster ..... 463/20
6,690,779 B2 * 2/2004 Walker et al. ..... 379/144.01
6,869,362 B2 * 3/2005 Walker et al. ..... 463/25
7,037,195 B2 * 5/2006 Schneider et al. ..... 463/25
2003/0148808 A1 * 8/2003 Price ..... 463/27
2003/0220138 A1 * 11/2003 Walker et al. ..... 463/25
2004/0002377 A1 * 1/2004 Staw et al. ..... 463/25
2004/0102238 A1 * 5/2004 Taylor ..... 463/16
2006/0040730 A1 * 2/2006 Walker et al. ..... 463/20
2006/0079321 A1 * 4/2006 Walker et al. ..... 463/25
2006/0211470 A1 * 9/2006 Walker et al. ..... 463/16
2007/0178958 A1 * 8/2007 Inamura ..... 463/17
2008/0064476 A1 * 3/2008 Okada ..... 463/20
2008/0119259 A1 * 5/2008 Okada ..... 463/20

FOREIGN PATENT DOCUMENTS

JP 2003-169881 A 6/2003
JP 2003-260191 9/2003
JP 2004-24323 1/2004
JP 2004-113547 A 4/2004
JP 2004-130119 A 4/2004

* cited by examiner

*Primary Examiner*—Peter DungBa Vo
*Assistant Examiner*—Seng Heng Lim
(74) *Attorney, Agent, or Firm*—Arent Fox LLP

(57) ABSTRACT

A gaming machine having a display device for variably displaying and stopping symbols during a game; a memory storing a lottery table having interrelated random number ranges, threshold target values (an accumulatively counted number of times the game has been played) and payouts; and a processor (a) to extract a random number, (b) to determine from the lottery table the random number range to which the random number belongs, (c) to determine the threshold target value corresponding to the determined random number range, (d) to accumulatively count a total number of times the game has been played while games are continuously conducted, (e) to determine whether or not the total number of game plays equals the determined threshold target value, and (f) to determine from the lottery table and give the related payout when the total number of game plays equals with the determined threshold target value.

8 Claims, 20 Drawing Sheets

| RANDOM NUMBER VALUE | NUMBER OF TIMES OF GAME TO START CEILING VALUE SYMBOL COMBINATION | PAYOUT | EFFECT NOTIFICATION |
|---|---|---|---|
| 0 ~ 25 | 100 | 500 | START BEFORE 10 GAMES |
| 26 ~ 63 | 400 | 500 | START BEFORE 30 GAMES |
| 64 ~ 127 | 700 | 500 | START BEFORE 50 GAMES |

| RANDOM NUMBER VALUE | NUMBER OF TIMES OF GAME TO START CEILING VALUE SYMBOL COMBINATION | PAYOUT | EFFECT NOTIFICATION |
|---|---|---|---|
| 0 ~ 25 | 200 | 500 | START BEFORE 10 GAMES |
| 26 ~ 63 | 500 | 500 | START BEFORE 30 GAMES |
| 64 ~ 127 | 800 | 500 | START BEFORE 50 GAMES |

| RANDOM NUMBER VALUE | NUMBER OF TIMES OF GAME TO START CEILING VALUE SYMBOL COMBINATION | PAYOUT | EFFECT NOTIFICATION |
|---|---|---|---|
| 0 ~ 25 | 300 | 500 | START BEFORE 10 GAMES |
| 26 ~ 63 | 600 | 500 | START BEFORE 30 GAMES |
| 64 ~ 127 | 900 | 500 | START BEFORE 50 GAMES |

FIG. 5

| CODE No | RANDOM NUMBER VALUE |
|---|---|
| 0 | 0 ~ 15 |
| 1 | 16 ~ 25 |
| 2 | 26 ~ 36 |
| 3 | 37 ~ 46 |
| 4 | 47 ~ 52 |
| 5 | 53 ~ 63 |
| 6 | 64 ~ 80 |
| 7 | 81 ~ 91 |
| 8 | 92 ~ 103 |
| 9 | 104 ~ 115 |
| 10 | 116 ~ 127 |

FIG. 6

| CODE No. | | | WINNING SYMBOL COMBINATION | PAYOUT |
|---|---|---|---|---|
| LEFT REEL | CENTER REEL | RIGHT REEL | | |
| 4 or 9 | 4 or 9 | 4 or 9 | 7 - 7 - 7 | 100 |
| 1 or 7 | 1 or 7 | 1 or 7 | 3BAR-3BAR-3BAR | 5 |
| 3 or 8 | 3 or 8 | 3 or 8 | 2BAR-2BAR-2BAR | 3 |
| 5 or 10 | 5 or 10 | 5 or 10 | BAR-BAR-BAR | 2 |
| 2 | 2 | 2 | CHERRY-CHERRY-CHERRY | 1 |
| COMBINATIONS OTHER THAN ABOVE | | | LOSS | 0 |

FIG. 11

| RANDOM NUMBER VALUE | NUMBER OF TIMES OF GAME TO START CEILING VALUE SYMBOL COMBINATION | PAYOUT | EFFECT NOTIFICATION |
|---|---|---|---|
| 0 ~ 25 | 100 | 500 | START BEFORE 10 GAMES |
| 26 ~ 63 | 400 | 500 | START BEFORE 30 GAMES |
| 64 ~ 127 | 700 | 500 | START BEFORE 50 GAMES |

| RANDOM NUMBER VALUE | NUMBER OF TIMES OF GAME TO START CEILING VALUE SYMBOL COMBINATION | PAYOUT | EFFECT NOTIFICATION |
|---|---|---|---|
| 0 ~ 25 | 200 | 500 | START BEFORE 10 GAMES |
| 26 ~ 63 | 500 | 500 | START BEFORE 30 GAMES |
| 64 ~ 127 | 800 | 500 | START BEFORE 50 GAMES |

| RANDOM NUMBER VALUE | NUMBER OF TIMES OF GAME TO START CEILING VALUE SYMBOL COMBINATION | PAYOUT | EFFECT NOTIFICATION |
|---|---|---|---|
| 0 ~ 25 | 300 | 500 | START BEFORE 10 GAMES |
| 26 ~ 63 | 600 | 500 | START BEFORE 30 GAMES |
| 64 ~ 127 | 900 | 500 | START BEFORE 50 GAMES |

FIG. 12

| RANDOM NUMBER VALUE | NUMBER OF TIMES OF GAME TO START CEILING VALUE SYMBOL COMBINATION | PAYOUT | EFFECT NOTIFICATION |
|---|---|---|---|
| 0 ~ 25 | 100 | 500 | START BEFORE 10 GAMES |
| 26 ~ 63 | 500 | 500 | START BEFORE 30 GAMES |
| 64 ~ 127 | 1000 | 500 | START BEFORE 50 GAMES |

FIG. 13

| RANDOM NUMBER VALUE | WINNING SYMBOL COMBINATION | PAYOUT |
|---|---|---|
| 0 ~ 22 | 7 - 7 - 7 | 100 |
| 23 ~ 25 | 3BAR - 3BAR - 3BAR | 5 |
| 26 ~ 48 | 2BAR - 2BAR - 2BAR | 3 |
| 49 ~ 193 | BAR - BAR - BAR | 2 |
| 194 ~ 247 | CHERRY-CHERRY-CHERRY | 1 |
| 248 ~ 1270 | LOSS | 0 |

GAMING MACHINE AND GAMING SYSTEM

CROSS-REFERENCE TO THE RELATED APPLICATIONS

This application is based upon and claims a priority from the prior Japanese Patent Application No. 2005-294599 filed on Oct. 7, 2005, the entire contents of which are incorporated herein by reference.

BACKGROUND OF THE INVENTION

1. Field of the Invention

The present invention relates to a gaming machine and a gaming system, in which a progressive Jack Pot system is conducted.

2. Description of Related Art

Conventionally, in a gaming system in which a plurality of gaming machines such as slot machines are linked, a system called a progressive Jack Pot is adopted that a predetermined percentage of the coins bet in each gaming machine is pooled among all of the coins bet in the gaming machines, and these coins that are pooled are paid out at one time when a specific winning combination with a low appearance probability is realized (for example, see Unexamined Japanese Publication No. 2004-130119).

Alternatively, a progressive Jack Pot system can independently conducted on a single machine.

In such progressive Jack Pot systems, since the probability of occurrence of the specific winning combination appearing is usually set low, therefore there will be many times when the amount of polled coins becomes enormous. Thus, the real pleasure of the dream of making a fortune at a stroke can be given to a player.

However, even if the player really continues to play games while aiming to win the progressive Jack Pot, it is an exceeding rare case that the player can get lucky enough to win the pooled coins; therefore, such a progressive Jack Pot is not enough to make the player have interest to continue playing.

SUMMARY OF THE INVENTION

Thus, the present invention has been done and has an object to provide a gaming machine and a gaming system in which interest of the player to continue playing can be aroused even in a case that the player gives up hope of realizing a progressive Jack Pot.

In order to accomplish the above object, according to one aspect of the present invention, a gaming machine is provided comprising:

a display device for variably displaying and stopping symbols during a game;

a memory storing a lottery table, the lottery table having interrelated random number ranges, threshold target values and payouts, each threshold target value being defined as an accumulatively counted number of times the game has been played; and a processor programmed to operate with the display device and the memory (a) to extract a random number, (b) to determine from the lottery table the random number range to which the random number belongs, (c) to determine the specific threshold target value corresponding to the determined random number range, (d) to accumulatively count a total number of times the game has been played while the games are continuously conducted, (e) to determine whether or not the total number of times the game has been played equals the determined specific threshold target value, and (f) to determine from the lottery table and give the related payout when the total number of times the game has been played equals with the determined specific threshold target value.

According to another aspect of the present invention, it is provided a gaming system in which plural gaming machines and a server are connected, each of the gaming machines comprises;

a display device for variably displaying and stopping symbols during a game; and a gaming machine processor programmed to operate with the display device (a) to conduct a lottery to determine a stop display manner of the symbols on the display device, (b) to control the display device to stop the symbols according to the stop display manner, and (c) to give a payout based on the stop display manner of the symbols;

the server comprises:

a memory storing a lottery table, the lottery table having interrelated random number ranges, threshold target values and payouts, each threshold target value being defined as an accumulatively counted number of times the game has been played; and a server processor (d) to extract a random number, (e) to determine from the lottery table the random number range to which the random number belongs, (f) to determine the threshold target value corresponding to the determined random number range, (g) accumulatively count-up a total number of times the game has been played while the games are continuously conducted in the gaming machine, (h) to determine whether or not the total number of times the game has been played equals the determined threshold target value, and (i) to determine from the lottery table and give the related payout to the gaming machine when the total number of times the game has been played equals the determined threshold target value.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention.

In the drawings,

FIG. 5 is an explanatory view showing a lottery table of stop display symbols, FIG. 6 is an explanatory view showing winning symbol combinations and payouts thereof, FIG. 11 is an explanatory view showing lottery tables for a number of times of a game to start a ceiling value symbol combination, or threshold target value, and payout tables of the ceiling value symbol combination, or threshold target value, with effect notification, FIG. 12 is an explanatory view showing a lottery table of the number of times of the game necessary to start the ceiling value symbol combination, or threshold target value, and a payout table of the ceiling value symbol combination, or threshold target value, and effect notification, FIG. 13 is an explanatory view showing a lottery table of the stop display symbols.

DETAILED DESCRIPTION OF THE PREFERRED EMBODIMENTS

Figure 1:
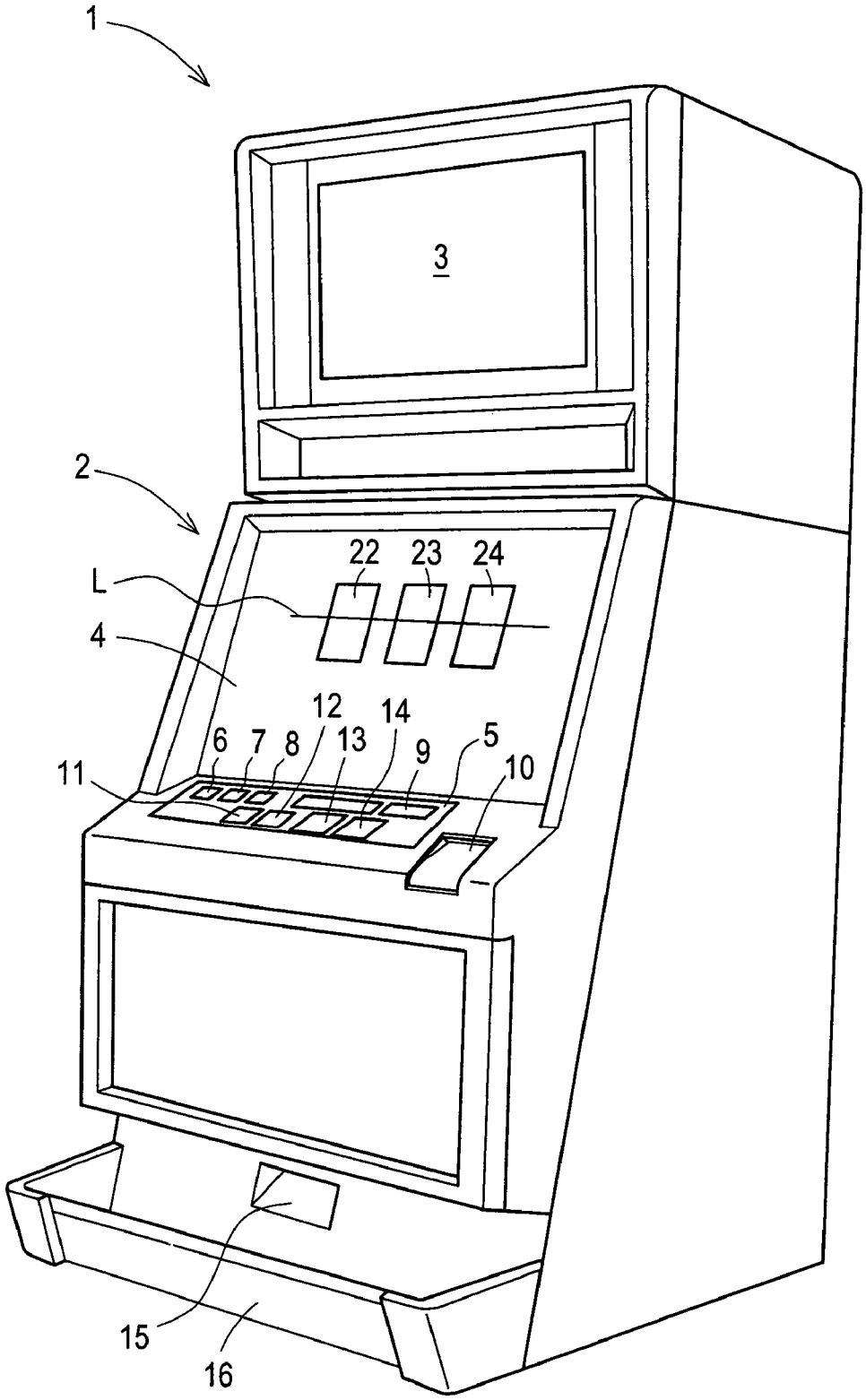
FIG. 1 is a perspective view of a slot machine.
Figure 2:
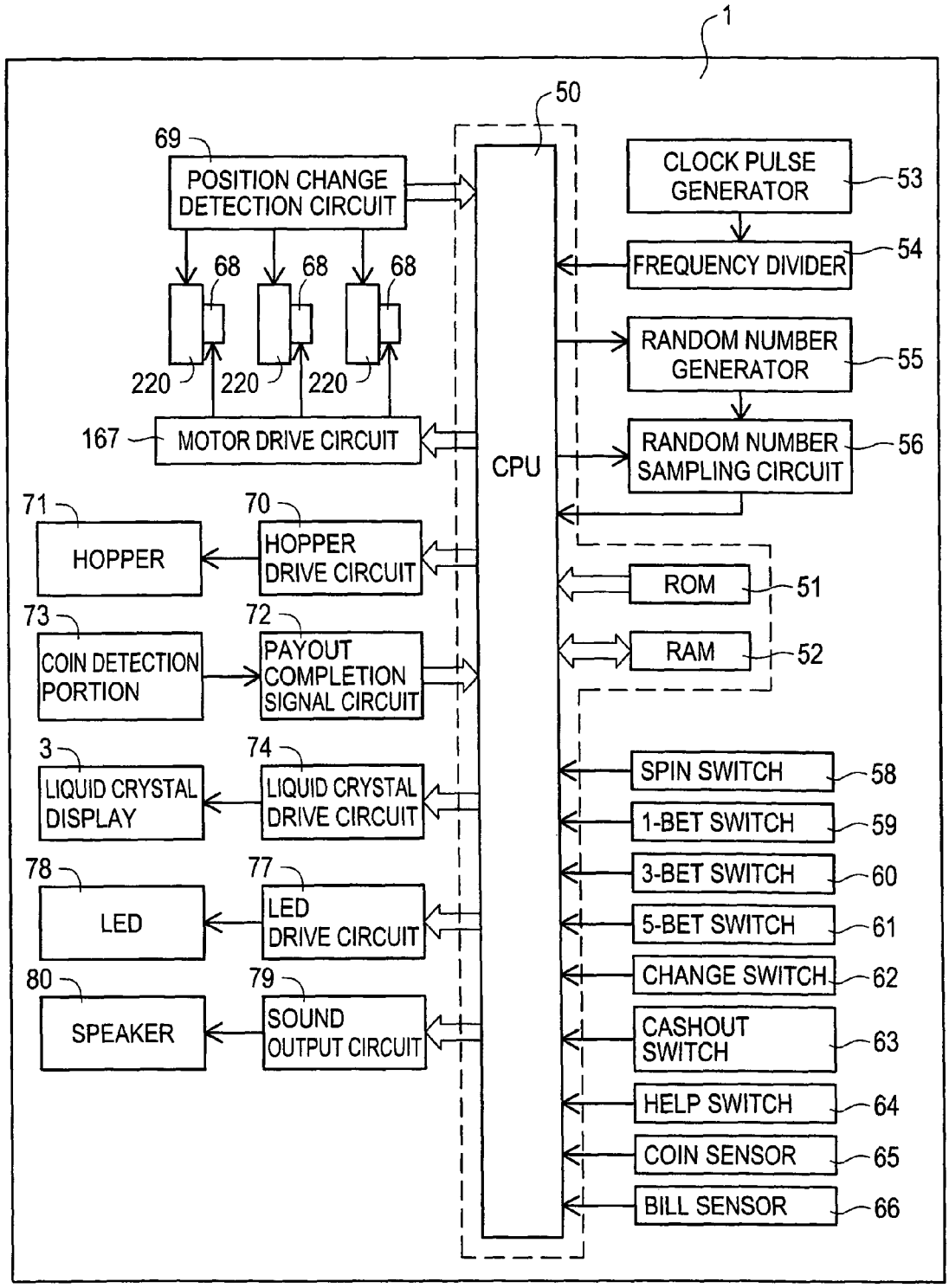
FIG. 2 is a block diagram schematically showing a control system of the slot machine.

Hereinafter, a gaming machine according to the present invention will be described in detail based on an embodiment which is embodied in a slot machine, with reference to the drawings. At first, an outline construction of the slot machine according to the embodiment will be described with reference to FIGS. 1 and 2. FIG. 1 is a perspective view of the slot machine. FIG. 2 is a block diagram schematically showing a control system of the slot machine.

In FIG. 1, the slot machine 1 has a cabinet 2. At a front upper position of the cabinet 2, a liquid crystal display 3 is arranged. At a front center position of the cabinet 2, a front panel 4 is arranged. Here, the liquid crystal display 3 is constructed from a conventional liquid crystal display. Information is displayed on the liquid crystal display 3 concerning details of the game such as game methods, kinds of winning combinations and payouts thereof, various effects and the like. Three variable display portions 22, 23, and 24 and an active pay line L are provided on the front panel 4. Various kinds of symbols are variably displayed on each of the variable display portions 22, 23, 24 while being scrolled from the top of the portion toward the bottom (see FIG. 4).

At an lower side of the front panel 4, a control panel 5 is provided and projects forwardly. A CHANGE button 6, a CASHOUT button 7 and a HELP button 8 are arranged on the control panel 5 from the most left side of the control panel 5. At the right side of the HELP button 8, a coin insertion slot 9 and a bill insertion portion 10 are provided. Further, in the forward side of the control panel 5, a 1-BET button 11, a SPIN (SPIN/REPEAT BET) button 12, a 3-BET button 13 and a 5-BET button 14 are provided in that order from the left side of the control panel 5.

The CHANGE button 6 is a button which is pressed when a bill inserted in the bill insertion portion 10 is exchanged with coins. The coins exchanged are paid out from a coin payout opening 15 to a coin receiver 16, both of which are provided at lower positions of the cabinet 2. A CHANGE switch 62 is attached to the CHANGE button 6 and a switch signal is output from the CHANGE switch 62 to a CPU 50 based on a user pressing the CHANGE button 6 (see FIG. 2).

The CASHOUT button 7 is a button which is pressed when the game is terminated. When the CASHOUT button 7 is pressed, coins won in the game are paid out from the coin payout opening 15 to the coin receiver 16. A CASHOUT switch 63 is attached to the CASHOUT button 7 and a switch signal is output from the CASHOUT switch 63 to the CPU 50 based on a user pressing the CASHOUT button 7 (see FIG. 2).

The HELP button is a button which is pressed when operation methods of the game cannot be understood. When the HELP button 8 is pressed before the game is started, help information is displayed on the liquid crystal display 3. When the HELP button 8 is pressed during the game, the total number of times the game has been played is displayed on the liquid crystal display 3. A HELP switch 64 is attached to the HELP button 8. A switch signal is output from the HELP switch 64 to the CPU 50 based on a user pressing the HELP button 8 (see FIG. 2).

A coin sensor 65 is connected to the coin insertion slot 9, and when coins are inserted in the coin insertion slot 9, a coin detection signal is output to the CPU 50 through the coin sensor 65 (see FIG. 2).

A bill sensor 66 is connected to the bill insertion portion 10, and when a bill is inserted in the bill insertion portion 10, a bill. detection signal is output to the CPU 50 through the bill sensor 66 (see FIG. 2).

The 1-BET button 11 allows one bet to be placed when the 1-BET button 11 is pressed. A 1-BET switch 59 is attached to the 1-BET button 11, and when the 1-BET button 11 is pressed, a switch signal is output from the 1-BET switch 59 to the CPU 50 based on a user pressing the 1-BET button 11.

The SPIN button 12 when pressed, starts the game with a bet number from the previous bet or a preset bet number depending on the user selection. A SPIN switch 58 is attached to the SPIN button 12, and when the SPIN button 12 is pressed, a switch signal is output from the SPIN switch 58 to the CPU 50 based on a user pressing the SPIN button 12 (see FIG. 2). The bet number bettable based on pressing the SPIN button 12 is 1 bet, 2 bets, 3 bets and 5 bets.

The 3-BET button 13 allows 3 bets to be placed when the 3-BET button 13 is pressed. A 3-BET switch 60 is attached to the 3-BET button 13, and when the 3-BET button 13 is pressed, a switch signal is output from the 3-BET switch 60 to the CPU 50 (see FIG. 2). The 5-BET button 14 allows 5 bets to be placed when the 5-BET button 14 is pressed. A 5-BET switch 61 is attached to the 5-BET button 14, and when the 5-BET button is pressed, a switch signal is output from the 5-BET switch 61 to the CPU 50 based on a user pressing the 5-BET button 14 (see FIG. 2).

At a lower position of the cabinet 2, the coin payout opening 15 and the coin receiver 16, which receives coins paid out from the coin payout opening 15, are formed. A coin detection portion 73, which is constructed from a sensor or the like, is arranged within the coin payout opening 15. The coin detection portion 73 detects a number of coins paid out from the coin payout opening 15 (see FIG. 2).

At a rear side of the front panel 4, three reels 220 are rotatably supported in a parallel state so as to be able to independently rotate (see FIG. 2). The game is conducted by using the symbols of the reels 220 which can be seen through each of the variable display portions 22 to 24 of the front panel 4.

Each of the reels 220 will now be described. Among the three reels 220, the left reel 220 when viewed from the front plane of the slot machine 1, faces the left variable display portion 22 formed on the front panel 4. Similarly, the center reel 220 faces the center variable display portion 23 formed on the front panel 4 of the slot machine 1. Further, the right reel 220 faces the right variable display portion 24 formed on the front panel 4 of the slot machine 1.

Figure 4:
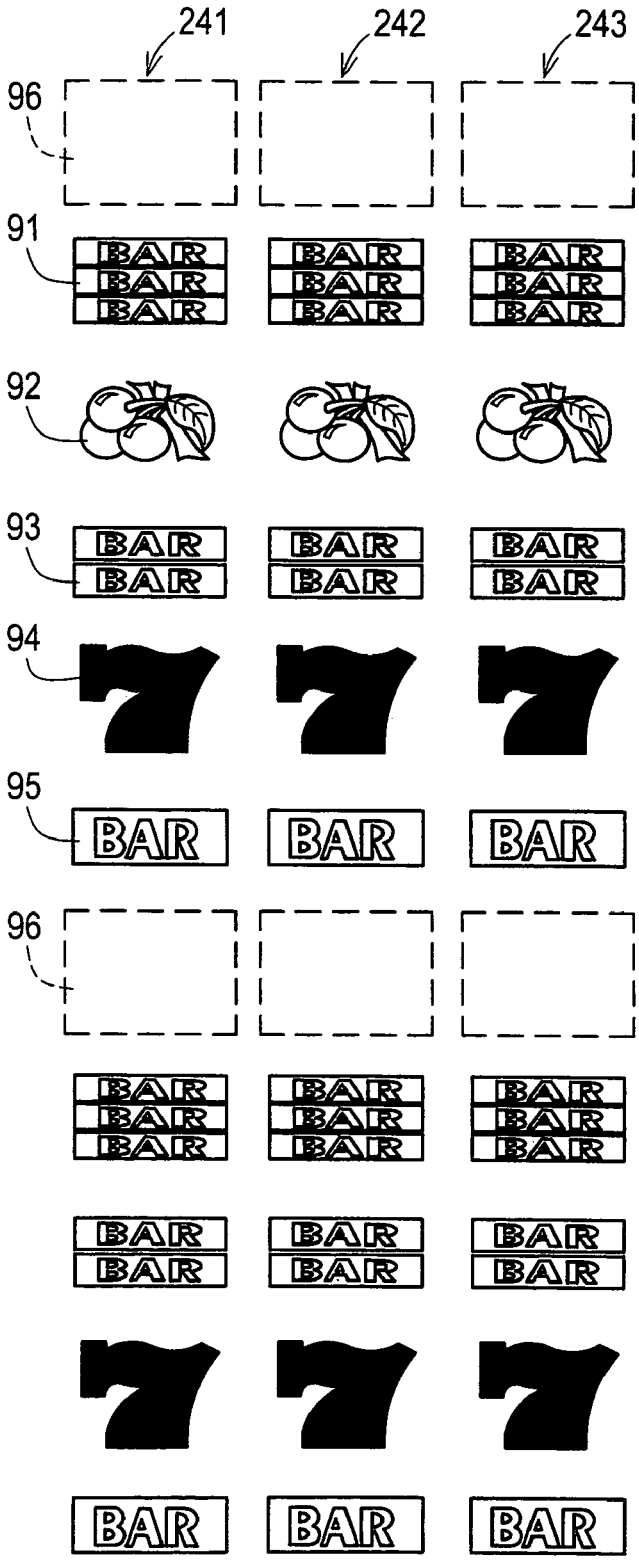
FIG. 4 is an explanatory view for explaining symbol columns variably displayed and stopped while scrolling in each of variable display portions, each of the symbol columns being formed on a periphery of each reel.

Next, with reference to FIG. 4, symbol columns which are variably displayed and stopped in each of the variable display portions 22 to 24 will be described. In FIG. 4, a symbol column 241 is variably displayed and stopped in the left variable display portion 22. A symbol column 242 is variably displayed and stopped in the center variable display portion 23. A symbol column 243 is variably displayed and stopped in the right variable display portion 24.

Each of the symbol columns 241 to 243 have the same symbol arrangement. Each symbol column is constructed from eleven symbols obtained by combining triple BAR 91, cherry 92, double BAR 93, seven 94, single BAR 95 and blank 96 (area that no symbol exists).

In a case when each of the symbol columns 241 to 243 variably displayed while scrolling in each of the variable display portions 22 to 24 is displayed and stopped, three symbols are stopped and displayed in each of the variable display portions.

Various winning symbol combinations are set beforehand based on plural possible symbol combinations. When the symbol combination corresponding to the winning symbol combination are stopped on the activated pay line L, coins are paid out corresponding to the winning symbol combination. This operation is the same as that in the conventional slot machine. Therefore, explanation thereof will be omitted.

In a case when various symbols are formed on a peripheral of each reel 220, the eleven symbols may be printed on a long reel sheet having a width and a peripheral length the same as those of each reel 220. The reel sheet is adhered to the peripheral of each reel 220. The symbols can be formed by methods other than the above method.

Next, with reference to FIG. 2, a control system of the slot machine 1 will be described. FIG. 2 is a block diagram schematically showing a control system of the slot machine 1.

In FIG. 2, the control system of the slot machine 1 is basically constructed from a CPU 50, which is the main component. A ROM 51 and a RAM 52 are connected to the CPU 50. A main process program, a lottery and stop control process program, various effect process programs to conduct various effects on the liquid crystal display 3 according to progress of the game, a lottery table used in a lottery of stop display symbols in the game, and other various programs necessary for control in the slot machine 1 and data tables are stored in the ROM 51. The RAM 52 is memory which temporarily stores various data calculated by the CPU 50.

A clock pulse generator 53 generating standard clock pulses and a frequency divider 54, a random number generator 55 generating random numbers, and a random number sampling circuit 56 are connected to the CPU 50. A random number sampled by the random number sampling circuit 56 is used in various lotteries of the winning symbol combination and the like. Further, a SPIN switch 58 attached to the SPIN button 12, a 1-BET switch 59 attached to the 1-BET button 11, a 3-BET switch 60 attached to the 3-BET button 13, a 5-BET switch 61 attached to the 5-BET button 14, a CHANGE switch 62 attached to the CHANGE button 6, a CASHOUT switch 63 attached to the CASHOUT button 7 and a HELP switch 64 attached to the HELP button 8 are all connected to the CPU 50. The CPU 50 conducts control to execute various operations corresponding to each button based on the switch signal output from each switch when each button is pressed.

Three stepping motors 68 for rotating each of the reels 220 through a motor drive circuit 167 and a position change detection circuit 69 are connected to the CPU 50. When a motor drive signal (instruction pulses) is output to the motor drive circuit 167 from the CPU 50, an excitation signal output from the motor drive circuit 167, causes each of the stepping motors 68 to rotate. Thereby, rotation of each reel 220 is conducted.

At that time, the CPU 50 counts a number of drive pulses provided to each stepping motor 68 and recognizes rotation positions of the symbols in each reel 220 based on the number of drive pulses counted, and thereafter conducts stop position control of the symbols.

The position change detection circuit 69 connected to the CPU 50 detects change of the stop position of the reel 220 after stop control of the reels 220 is conducted by the motor drive circuit 167.

Further, a coin sensor 65 arranged in the coin insertion slot 9 and a bill sensor 66 arranged in the bill insertion portion 10 are respectively connected to the CPU 50. The coin sensor 65 detects coins inserted from the coin insertion slot 9 and the CPU 50 calculates a number of inserted coins based on a coin detection signal output from the coin sensor 65. The bill sensor 66 detects a the type and amount of the bill inserted in the bill insertion portion 10 and the CPU 50 calculates a number of coins equivalent to the amount of the bill based on a bill detection signal output from the bill sensor 66.

A hopper 71 is connected through a hopper drive circuit 70 to the CPU 50. When a drive signal is output to the hopper drive circuit 70 from the CPU 50, the hopper 71 pays out a predetermined number of coins from the coin payout opening 15.

A coin detection portion 73 is connected to the CPU 50 through a payout completion signal circuit 72. The coin detection portion 73 is arranged within the coin payout opening 15, and when the coin detection portion 73 detects that a predetermined number of coins are paid out from the coin payout opening 15, a coin payout detection signal is output to the payout completion signal circuit 72 from the coin detection portion 73. Based on this, the payout completion signal circuit 72 outputs a payout completion signal to the CPU 50. Further, the liquid crystal display 3 is connected to the CPU 50 through a liquid crystal drive circuit 74, and the liquid crystal display 3 is controlled by the CPU 50.

Figure 3:
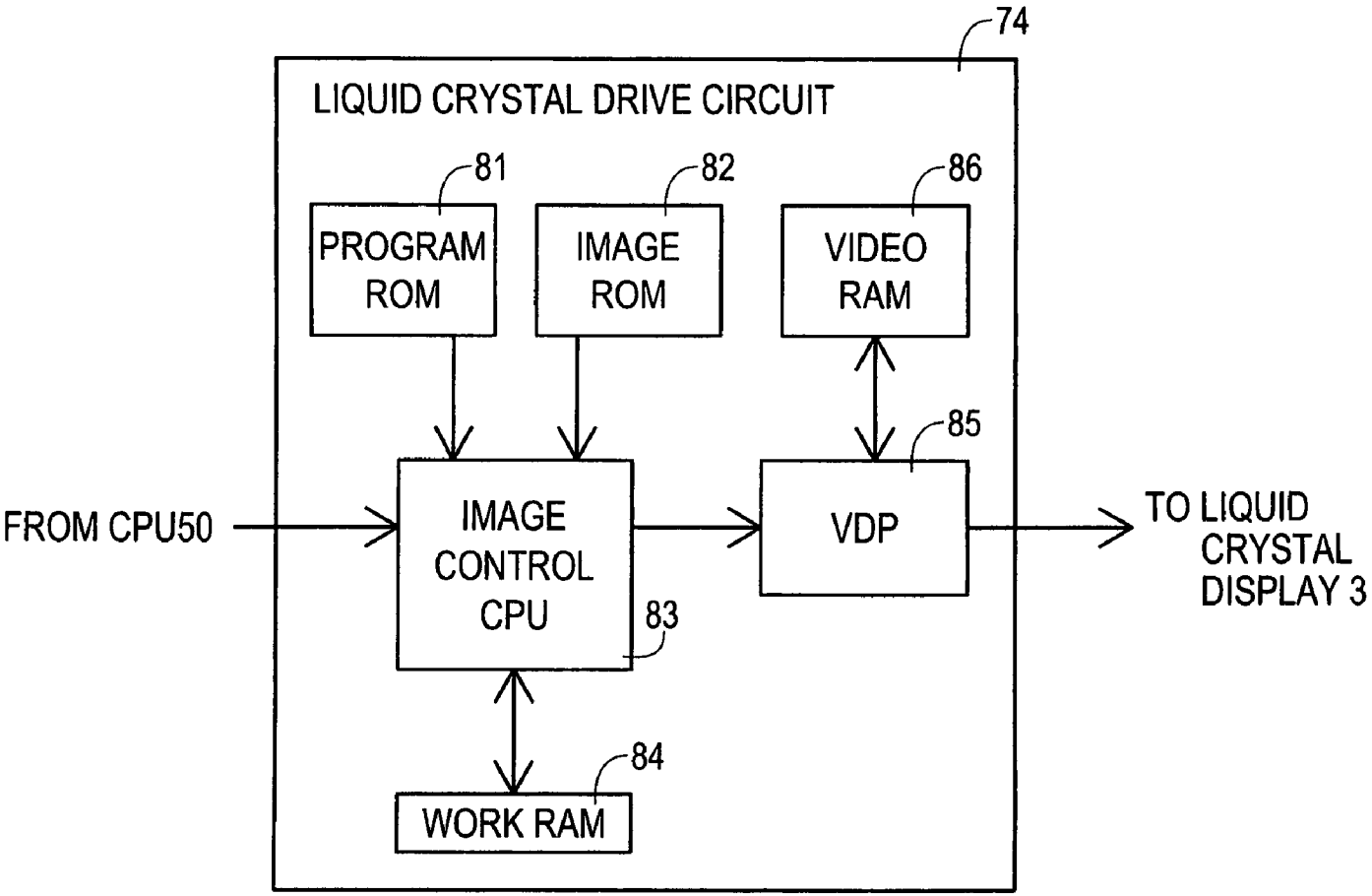
FIG. 3 is a block diagram schematically showing a liquid crystal drive circuit of a liquid crystal display.

As shown in FIG. 3, the liquid crystal drive circuit 74 is constructed from a program ROM 81, an image ROM 82, an image control CPU 83, a work RAM 84, a VDP 85 (Video Display Processor) and a video RAM 86. An image control program relating to the display on the liquid crystal display 3 and various selection tables are stored in the program ROM 81. Dot data for forming images displayed on the liquid crystal display 3 may be stored, for example, in the image ROM 82. Further, the image control CPU 83 determines the image displayed on the liquid crystal display 3 based upon the dot data stored beforehand in the image ROM 82, and the image control program stored beforehand in the program ROM 81 based on parameters set by the CPU 50. The work RAM 84 is constructed as a temporary memory to be used when the image control program is executed by the image control CPU 83. Further, the VDP 85 forms the image corresponding to display contents determined by the image control CPU 83 and outputs it to the liquid crystal display 3. In this case, the video RAM 86 is constructed as a temporary memory when images are formed by the VDP 85.

Returning to FIG. 2, LEDs 78 are connected to the CPU 50 through a LED drive circuit 77. Numerous LEDs 78 are arranged on the front plane of the slot machine 1 and are controlled so as to turn on and off through the LED drive circuit 77 based on drive signals from the CPU 50 when various conditions occur. Further, a sound output circuit 79 and a speaker 80 are connected to the CPU 50. The speaker 80 outputs various sounds based on an output signal from the sound output circuit 79 when various conditions occur.

With reference to FIG. 5, a lottery table which is used when the symbols stopped and displayed on the activated pay line L are determined while the game is conducted by using three variable display portions 22 to 24 in the slot machine 1 will now be described. FIG. 5 is an explanatory view showing a lottery table of the stop display symbols used when the game is conducted by using three variable display portions.

The symbol stopped and displayed on the activated pay line L is determined for each of variable display portions 22 to 24. In order to achieve this, code numbers "0"~"10" are allotted to the symbols in order from the uppermost symbol in each of the symbol columns 241 to 243 respectively corresponding to each of the variable display portions 22 to 24. Further, a table shown in FIG. 5 is prepared. Three random numbers corresponding to each of the variable display portions 22 to 24 are sampled through the random number sampling circuit 56.

Hereinafter, for convenience sake, the symbol column 241 of the left variable display portion 22 is described as "left reel", the symbol column 242 of the center variable display portion 23 is described as "center reel" and the symbol column 243 of the right variable display portion 24 is described as "right reel".

As for the "left reel" of the symbol column 241 in the left variable display portion 22, as shown in the lottery table of FIG. 5, if the random number sampled by the random number sampling circuit 56 lies in a range of 0~15, the blank 96 allotted to the code number "0" is stopped and displayed on the activated pay line L. Similarly, as for each of the code numbers of "1"~"10", the symbol stopped and displayed on the activated pay line L is determined based on the lottery table shown in FIG. 5.

As for the "center reel" of the symbol column 242 of the center variable display portion 23 and the "right reel" of the symbol column 243 of the right variable display portion 24, the same process as the "left" reel of the symbol column 241 of the left variable display portion 22 is conducted.

Next, with reference to FIG. 6, the winning symbol combinations and payouts thereof in a case that the game is conducted by using three variable display portions 22 to 24 in the slot machine 1 will be described. FIG. 6 is an explanatory view showing winning symbol combinations and payouts thereof in a case that the game is conducted by using three variable display portions. In FIG. 6, in a case that the code number of the "left reel", the "center reel" and the "right reel" is "4" or "9", the winning symbol combination "7-7-7" is won. In this case, the symbol seven 94 is stopped and displayed. on the activated pay line L in all of the variable display portions 22 to 24, and the payout "100" is obtained. Similarly to the above, each of the payout "5", "3", "2" and "1" is done based on the table shown in FIG. 6.

In a case that the code number of the "left reel", the "center reel" and the "right reel" is determined as a combination other than the combinations shown in FIG. 6, the game is lost. In this case, although any of the triple BAR 91, the cherry 92, the double BAR 93, the seven 94, the single BAR 95 or the blank 96 is stopped and displayed on the activated pay line L in each of the variable display portions 22 to 24, the payout cannot be obtained.

Figure 7:
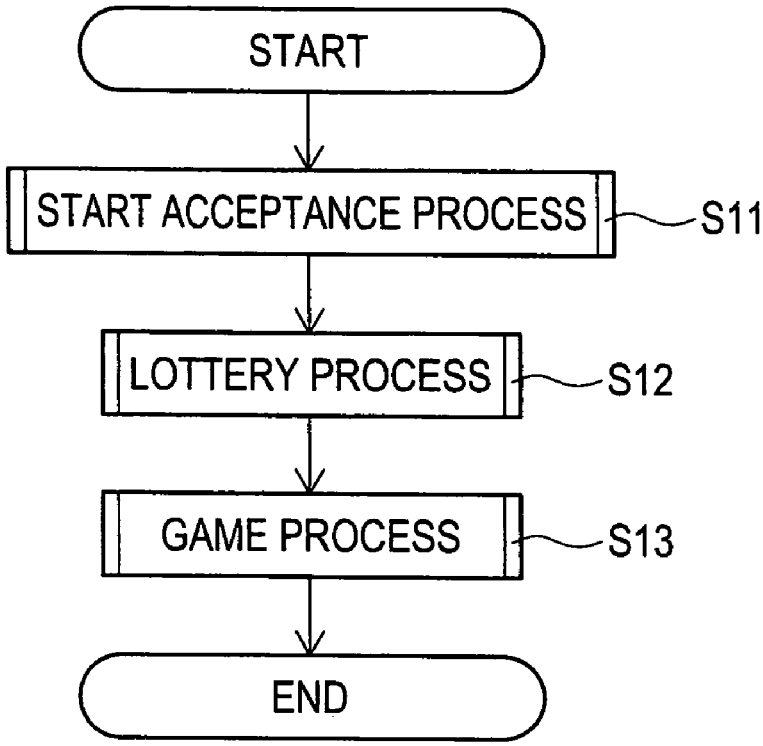
FIG. 7 is a flowchart of a main process program.
Figure 8:
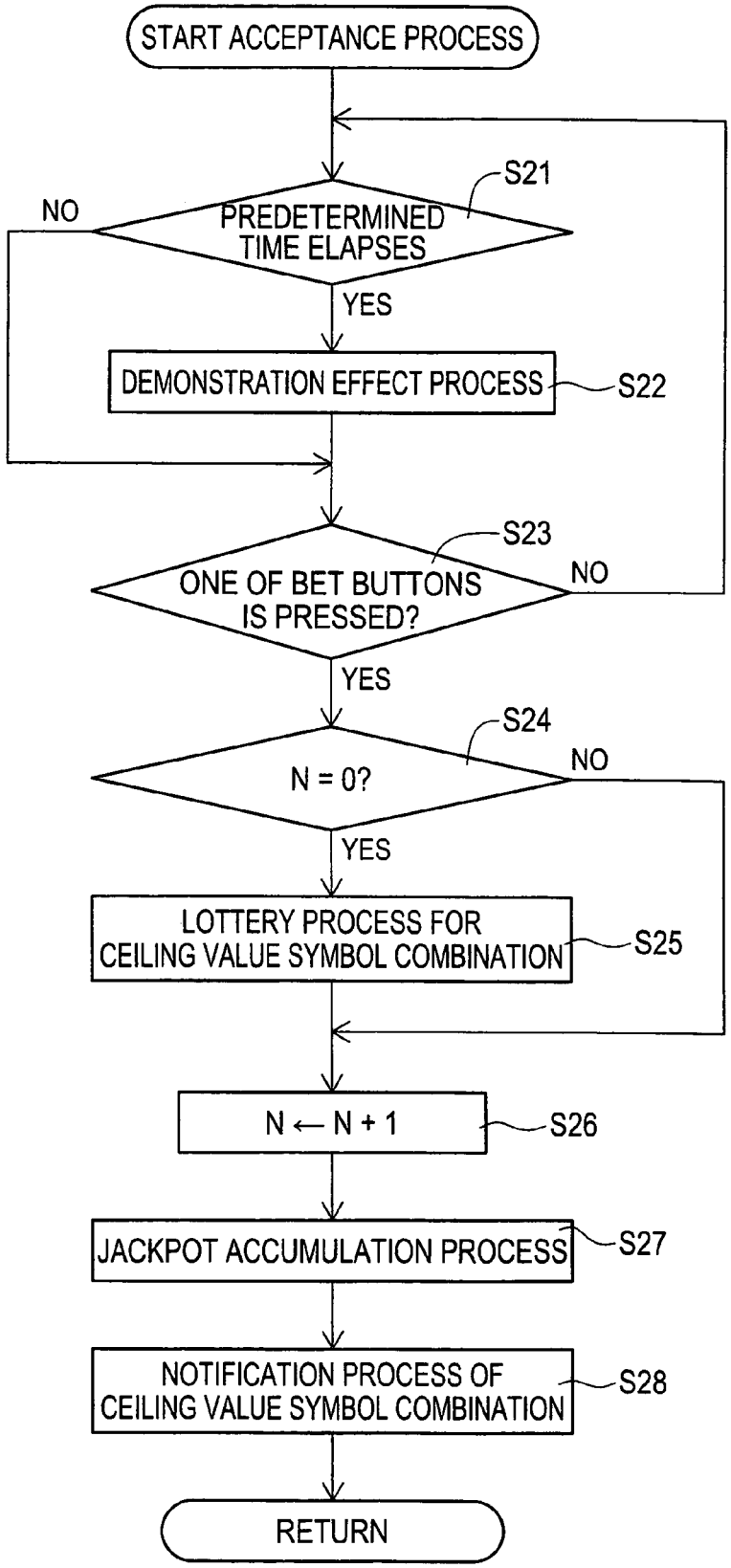
FIG. 8 is a flowchart of a start acceptance process program.

Next, a main process program executed in the slot machine 1 will be described with reference to FIG. 7. FIG. 7 is a flowchart of the main process program. In FIG. 7, at first, in step (abbreviated as "S" hereinafter) 11, a start acceptance process of FIG. 8 is conducted. This is a process to accept the switch signal output from the SPIN switch 58, the 1-BET switch 59, the 3-BET switch 60 or the 5-BET switch 61 based on operation of the SPIN button 12, the 1-BET button 11, the 3-BET button 13 or the 5-BET button 14. At the time that the switch signal output from each switch is accepted, the game is started.

Figure 9:
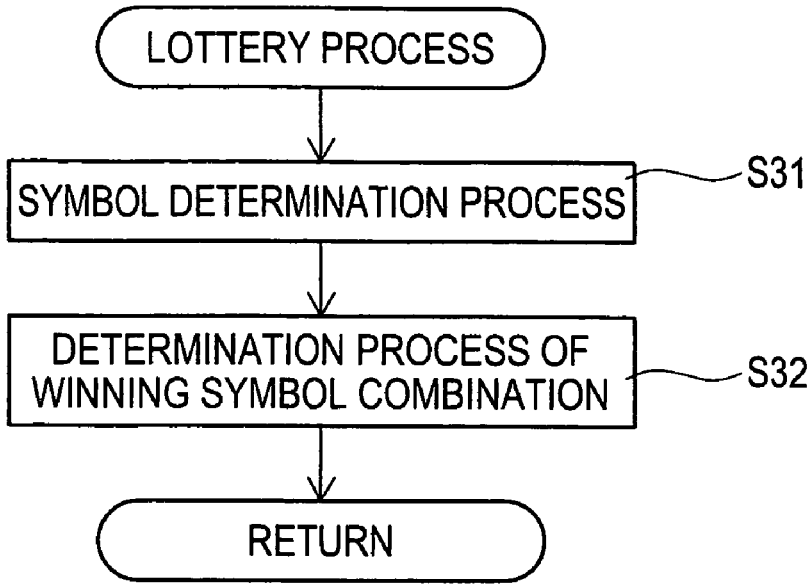
FIG. 9 is a flowchart of a lottery process program.

In S12, a lottery process of FIG. 9 is conducted based on the switch signal output from the SPIN switch 58, the 1-BET switch 58, the 3-BET switch 60 or the 5-BET switch 61.

Figure 10:
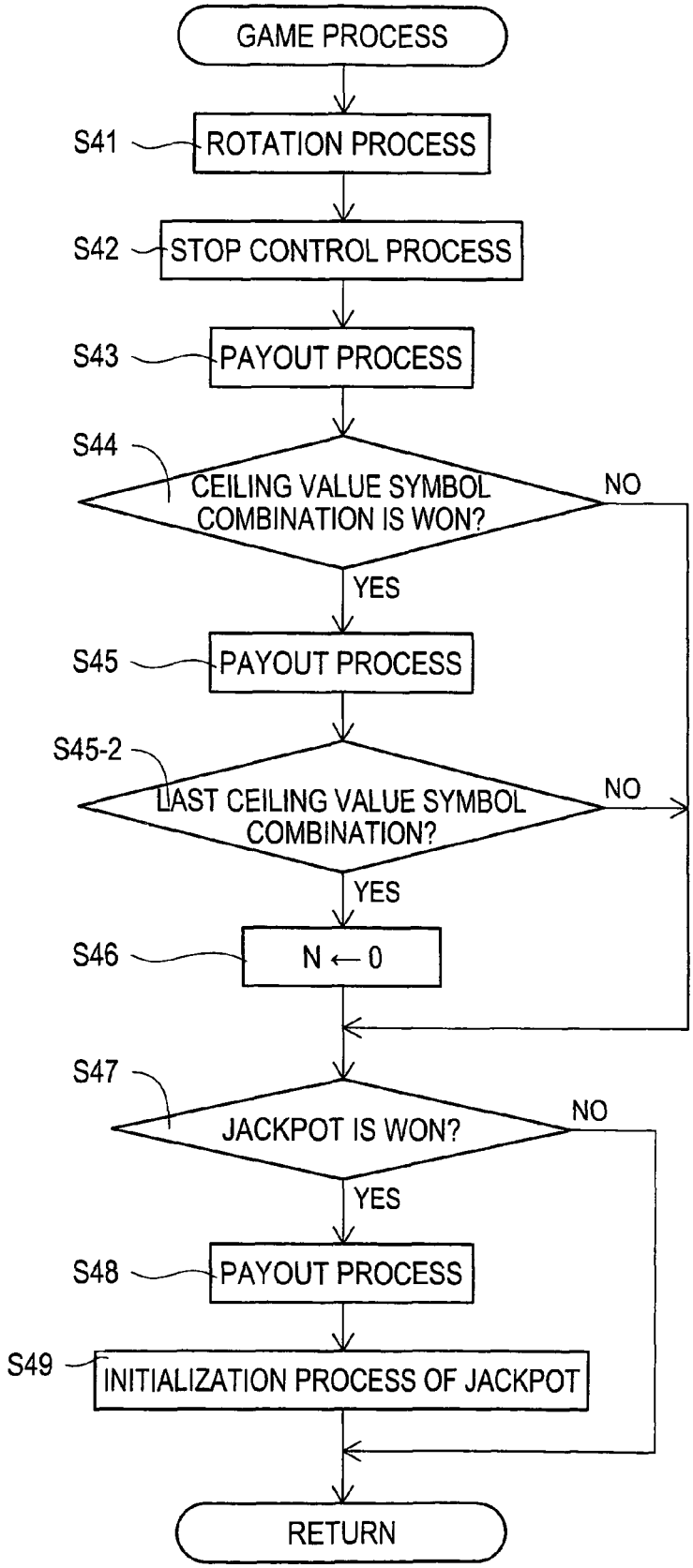
FIG. 10 is a flowchart of a game process program.

Next, in S13, a game process of FIG. 10 is conducted, thereafter the main process program is terminated.

The start acceptance process program performed in the slot machine 1 will be described with reference to FIG. 8. FIG. 8 is a flowchart of the start acceptance process program. After the start of the acceptance process of FIG. 7 is started in S11, the procedure shifts to S21 of FIG. 8. In S21, it is determined whether or not a predetermined time (for example, 15 seconds) elapses. Here, if it is determined that the predetermined time does not elapse (S21: NO), the procedure shifts to S23. On the other hand, if it is determined that the predetermined time elapses (S21: YES), a demonstration display is conduced on the liquid crystal display 3 in S22. Thereafter, the procedure shifts to S23. In S23, it is determined whether or not the SPIN button 12, the 1-BET button 11, the 3-BET button 13 or the 5-BET button 14 is operated. If it is determined that any one of the buttons is not operated (S23: NO), the procedure returns to S21 and the procedures mentioned above are repeated. On the other hand, if it is determined that any one of the buttons is operated (S23: YES), the procedure shifts to S24 even while the demonstration display is conducted.

In S24, it is determined whether or not the total number of times N the game has been played is "0". Here, if it is determined that the total number of times N the game has been played is not "0" (S24: NO), the procedure shifts to S26. On the other hand, if it is determined that the total number of times N the game has been played is "0" (S24: YES), a lottery process for starting a ceiling value symbol combination, or threshold target value, of S25 is conducted. Thereafter, the procedure shifts to S26.

The lottery process for starting the ceiling value symbol combination, or threshold target value, in S25 will be described. FIG. 11 is an explanatory view showing lottery tables of a number of times the game must be played to start the ceiling value symbol combination, or threshold target value, and payout tables of the ceiling value symbol combination, or threshold target value, with result notification. In the lottery process for the ceiling value symbol combination, or threshold target value, of S25 in FIG. 8, three random numbers are sampled within a range of 0~127 through the random number sampling circuit 56, and one value of the number of times the game must be played to start the ceiling value symbol combination, or threshold target value, is determined based on each of three tables in FIG. 11. Concretely, if the first random number value sampled through the random number sampling circuit 56 lies in a range of 0~25, "100" is determined as the number of times the game must be played to start the ceiling value symbol combination, or threshold target value, based on the upper table in FIG. 11. If the second random number value sampled through the random number sampling circuit 56 lies in a range of 26~63, "500" is determined as the number times of the game must be played to start the ceiling value symbol combination, or threshold target value, based on the middle table in FIG. 11. Further, if the third random number value sampled through the random number sampling circuit 56 lies in a range of 64~127, "900" is determined as the number of times the game must be played to start the ceiling value symbol combination, or threshold target value, based on the lower table in FIG. 11. That is to say, three ceiling values of the number of times the game must be played to start the ceiling value symbol combination, or threshold target value, are determined in the lottery process for ceiling value symbol combination, or threshold target value, in S25.

The ceiling value symbol combination, or threshold target value, is a symbol combination through which a payout is given when the total number of times N the game has been played reaches to the value (threshold) determined as the number of times the game must be played to start the ceiling value symbol combination, or threshold target value. For example, in the lottery process for the ceiling value symbol combination, or threshold target value, in S25, if three of the number of times the game must be played to start the ceiling value symbol combination, or threshold target value, each of which is determined based on each of three tables in FIG. 11, are respectively "400", "800", "300", each time the total number of times N the game has been played becomes "300", "400" and "800", the payout of "500" is given. Here, the total number of times N the game has been played is stored in a memory area formed in the RAM 52, and after the payout is given, the total number of times N the game has been played is initialized to "0" (see S46 of FIG. 10 mentioned later).

In the lottery process for starting the ceiling value symbol combination, or threshold target value, in S25, the lottery of plural numbers of times the game must be played to start the ceiling value symbol combination, or threshold target value, may be conducted beforehand through the random number sampling circuit 56. Thereafter three of the number of times the game must be played to start the ceiling value symbol combination, or threshold target value, may be determined by a lottery among such plural numbers of times the game must be played to start the ceiling value symbol combination, or threshold target value. In this case, the lottery done beforehand may be conducted right before three of the number of times the game must be played to start the ceiling value symbol combination, or threshold target value, are determined within the lottery process for ceiling value symbol combination, or threshold target value, of S25, or for example, may be conducted when the total number of times N the game has been played is reset in S46 by substituting the number N for "0".

Returning to FIG. 8, in S26, "1" added to the total number of times N the game has been played at present, thereby the total number of times N the game has been played in this time is calculated. Further, in S27, a Jack Pot accumulation process is conducted.

Here, in the Jack Pot accumulation process of S27, a portion of the coins (worth equivalent thereto) betted is added to progressive Jack Pot. Here, the progressive Jack Pot is stored in a memory area formed in the RAM 52.

In S28, a process to notify the start of the ceiling value symbol combination, or threshold target value, is conducted. In this process, when the total number of times N the game has been played reaches to a predetermined number that is smaller than the value determined as the number of times the game must be played to start the ceiling value symbol combination, or threshold target value, the player is thereafter notified after every conducted that the payout for the ceiling value symbol combination, or threshold target value, is given, by displaying the tables shown in FIG. 11 on the liquid crystal display 3. Concretely, for example, in a case that three numbers of times the game must be played to start the ceiling value symbol combination, or threshold target value, each of which is determined based on each of three tables in FIG. 11, are respectively "700", "200", "600", when the total number of times N the game has been played becomes "190" which is smaller than "200" by "10", the tables shown in FIG. 11 are displayed on the liquid crystal display 3 after every game is completed until the total number of times N the game has been played reaches to "200". When the total number of times N the game has been played becomes "570" which is smaller than "600" by "30", the tables shown in FIG. 11 are displayed on the liquid crystal display 3 after every completed until the total number of times N the game has been played reaches to "600". Further, when the total number of times N the game has been played becomes "650" which is smaller than "700" by "50", the tables shown in FIG. 11 are displayed on the liquid crystal display 3 after every game is completed until the total number of times N the game has been played reaches to "700".

Thereafter, the procedure returns to the main process program of FIG. 7 and shifts to the lottery process in S12.

Next, a lottery process program conducted in the slot machine 1 will be described with reference to FIG. 9. FIG. 9 is a flowchart of the lottery process program. After the lottery process is started in S12 of FIG. 7, the procedure shifts to S31 of FIG. 9 and a symbol determination process is conducted. The symbol stopped and displayed on the activated pay line L is determined for each of the variable display portions 22, 23, 24 during the game (S42 of FIG. 10). Concretely, as mentioned in the above, three random number values are sampled within a range of 0~127 through the random number sampling circuit 56, so as to correspond to each of the variable display portions 22, 23, 24, and the stop display symbols are determined through the code numbers based on the lottery table shown in FIG. 5. After the symbols stopped and displayed on the activated pay line L are determined, a winning symbol combination determination process is performed in S32. In the symbol combination determination process, concretely speaking, the winning symbol combination and the payout thereof are determined based on the table in FIG. 6 through the code numbers determined in S31. Thereafter, procedure returns to the main process program and shifts to the game process in S13.

Next, the game process program conducted in the slot machine 1 will be described with reference to FIG. 10. FIG. 10 is a flowchart of the game process. After the game process is started in S13 of the main process program shown in FIG. 7, procedure shifts to S41 of FIG. 10 and a rotation process is conducted. In this rotation process, concretely speaking, the reels 220 positioned at the rear side of the variable display portions 22, 23, 24 begin to rotate based on the switch signal output from the SPIN switch 58, the 1-BET switch 59, the 3-BET switch 60 or the 5-BET switch 61, the switch signal being accepted in S11 of FIG. 7.

Thereby, through the variable display portions 22, 23, 24, the symbol columns 241, 242, 243 formed on the peripheries of the reels 220 are variably displayed while scrolling. Thus, variable display of the symbols is performed.

In S42, a stop control process is conducted. In this stop control process, concretely speaking, each of reels 220 positioned at the rear side of the variable display portions 22 to 24 are stopped for each of the variable display portions 22, 23, 24. Thereby, each of the symbol columns 241, 242, 243 formed on the peripheries of the reels 220 is stopped. Thus, each of the symbols is stopped and displayed.

In S43, according to the winning symbol combination stopped and displayed in each of the variable display portions 22, 23, 24, coins corresponding to the preset payout are paid out based on the table in FIG. 6.

In S44, it is determined whether or not the ceiling value symbol combination, or threshold target value, is won. This determination is done based on whether or not the total number of times N the game has been played calculated in S26 of FIG. 8 coincides with any of three numbers of times the game must be played to start the ceiling value symbol combination, or threshold target value, determined in S25 of FIG. 8. If it is determined that the ceiling value symbol combination, or threshold target value, is not won (S44: NO), the procedures shifts to S47. On the other hand, if it is determined that the ceiling value symbol combination, or threshold target value, is won (S44: YES), coins (for example, 500 coins) corresponding to the preset payout are paid out, based on the tables in FIG. 11 in S45. In S45-2, it is determined whether or not the ceiling value symbol combination, or threshold target value, is the last ceiling symbol combination, or threshold target value. This determination is done based on whether or not the total number of times N the game has been played calculated in S26 of FIG. 8 coincides with the maximum number of times the game must be played to start the ceiling value symbol combination, or threshold target value, among three numbers of times the game must be played to start the ceiling value symbol combination, or threshold target value, determined in S25 of FIG. 8. Here, if it is determined that the ceiling value symbol combination, or threshold target value, is not the last ceiling symbol combination, or threshold target value, (S45-2: NO), the procedure shifts to S47. On the other hand, if it is determined that the ceiling value symbol combination, or threshold target value, is the last ceiling symbol combination (S45-2: YES), "0" is substituted for the total number of times N the game has been played, thereafter the procedure shifts to S47.

In S47, it is determined whether or not the Jack Pot is won. In this determination, it is determined that the Jack Pot is won only if the random number value sampled within a range of 0~1023 through the random number sampling circuit 56 is "0". Instead, for example, it may be determined that the Jack Pot is won only if the symbol combination "7-7-7" is won in S12 of FIG. 7.

In S47, if it is determined that the Jack Pot is not won (S47: NO), the main process program of FIG. 7 is terminated, and the main process program in FIG. 7 is started anew. On the other hand, if it is determined that the Jack Pot is won (S47: YES), coins corresponding to the progressive Jack Pot which is accumulated up to this step are paid out in S48. Further, in an initialization process of the Jack Pot in S49, "0" is substituted for the progressive Jack Pot, thereby the progressive Jack Pot is reset. Thereafter, the main process program of FIG. 7 is terminated and the main process program in FIG. 7 is started anew.

As mentioned in detail, in the slot machine 1 of the embodiment, a portion of coins (worth equivalent thereto) bet is added to the progressive Jack Pot (S27). Thereafter, if it is determined that the Jack Pot is won (S47: YES), coins (for example, 10000 coins) corresponding to the progressive Jack Pot accumulated up to this step are paid out (S48). Here, a condition to win the progressive Jack Pot is limited to a situation when the random number value sampled within a range of 0~1023 through the random number sampling circuit 56 is "0". Therefore, in many cases, the progressive Jack Pot becomes enormous. Thus, although the possibility of winning a large Jack Pot is given to the player, on the contrary, even if the player continues to play games while aiming for the progressive Jack Pot, there will rarely be a case where the player will obtain the progressive Jack Pot. Therefore, the player generally gives up from the start from attempting to obtain the progressive Jack Pot.

However, in the slot machine of the embodiment, there are three numbers of times the game must be played to start the ceiling value symbol combination, or threshold target value, are determined (S25) based on the lottery using three random number values sampled within a range of 0~127 through the random number sampling circuit 56 and three tables of FIG. 11. Coins corresponding to the preset payout (ceiling value symbol combination), are paid out (S45) based on the tables in FIG. 11 every time number of times N the game has been played reaches to each of three numbers of times the game must be played to start the ceiling symbol combination, or threshold target value (S44). Thereby, if the player continues to play a maximum 900 slot games to aim for the ceiling value symbol combination, or threshold target value, the player can surely win the ceiling value symbol combination, or threshold target value, in three times. Therefore, even if the player gives up attempting to obtain the progressive Jack Pot, part of the coins (worth equivalent thereto) bet is accumulated every game, and therefore the interest of the player to continue the slot games can be sufficiently maintained.

The payout corresponding to the ceiling value symbol combination, or threshold target value, may be set to the same value as shown in FIG. 11 with no relation to the number of times the game must be played to start the ceiling value symbol combination, or threshold target value. A payout corresponding to the ceiling value symbol combination, or threshold target value, may be set differently according to the number of times the game must be played to start the ceiling value symbol combination, or threshold target value.

In the slot machine 1 of the embodiment, after the total number of times N the game has been played reaches the predetermined number that is smaller than the value determined as the number of times the game must be played to start the ceiling value symbol combination, or threshold target value, the player is thereafter notified after every game conducted that the payout corresponding to the ceiling value symbol combination, or threshold target value, is given, by displaying the tables shown in FIG. 11 on the liquid crystal display 3.

Therefore, for example, it is clear for the player that if the notification is not started after the total number of times N the game has been played becomes "90", the ceiling value symbol combination, or threshold target value, cannot be won even if the total number of times N the game has been played becomes "100" and the ceiling value symbol combination, or threshold target value, can be won after the total number of times N the game has been played becomes more than "200". It is clear that if the notification is not started after the total number of times N the game has been played becomes "190", the ceiling value symbol combination, or threshold target value, cannot be won even if the total number of times N the game has been played becomes "200" and the ceiling value symbol combination, or threshold target value, can be won after the total number of times N the game has been played becomes more than "300". Further, it is clear that if the notification is not started after the total number of times N the game has been played becomes "290", the ceiling value symbol combination, or threshold target value, cannot be won even if the total number of times N the game has been played becomes "300" and the ceiling value symbol combination, or threshold target value, can be won after the total number of times N the game has been played becomes more than "400". Similarly to the above, if the notification is not started after the total number of times N the game has been played becomes "370", "470", "570", "650", "750" or "850", it is clear to the player that the same situations as the above has occurred. Therefore, since an index to win the ceiling value symbol combination, or threshold target value, is provided, interest of the player to continue the slot games can be sufficiently maintained.

Here, the manner of the notification corresponding to the number of times the game must be played to start the ceiling value symbol combination, or threshold target value, are described as an example, and thus it is not limited to this description. For example, when the tables shown in FIG. 11 are displayed on the liquid crystal display 3, the difference between the total number of times N the game has been played at present and the number of times the game must be played to start the ceiling value symbol combination, or threshold target value, which is the nearest to the number N may be displayed.

Here, the present invention is not limited to the embodiment and various changes, modifications can be done within the scope of the present invention.

For example, in the slot machine 1 of the embodiment, although three numbers of times the game must be played to start the ceiling value symbol combination, or threshold target value, are determined (S25) by using three tables shown in FIG. 11 in which plural numbers of times the game must be played to start the ceiling value symbol combination, or threshold target value, are provided, one table may be used in which many numbers of times the game must be played to start the ceiling value symbol combination, or threshold target value, are provided. The number of times the game must be played to start the ceiling value symbol combination, or threshold target value, may be set only to one number. The number of times the game must be played to start the ceiling value symbol combination, or threshold target value, may be determined (S25) based on one table shown in FIG. 12.

In the slot machine 1 of the embodiment, when the HELP button 8 is pressed during the game, the total number of times N the game has been played is displayed on the liquid crystal display 3. Here, the total number of times N the game has been played may not be displayed. In this case, the player does not know the number of times N the game has been played and may think that coins corresponding to the payout of the ceiling value symbol combination, or threshold target value, will suddenly be paid out. Therefore, the player expects a sudden payout of coins and the interest of the player to continue to play the slot games can be sufficiently maintained.

In the slot machine of the embodiment, although the value determined as the number of times the game must be played to start the ceiling value symbol combination, or threshold target value, corresponds to the total number of times N the game has been played, instead of this, such value may correspond to the value of the progressive Jack Pot with a specific manner such as "1111", "2222", "9999", "1000", "2000", "9000". However, in this case, coins paid out for the ceiling value symbol combination, or threshold target value, are subtracted from the progressive Jack Pot.

Further, in the slot machine 1 of the embodiment, if it is determined that the total number of times N the game has been played is "0" (S24: YES), three numbers of times the game must be played to start the ceiling value symbol combination, or threshold target value, are determined (S25). Here, a specific operation button may be provided on the control panel 5 or the touch panel and three numbers of times the game must be played to start the ceiling value symbol combination, or threshold target value, may be determined based on press operation of the specific operation button.

In the slot machine 1 of the embodiment, the symbols stopped and displayed on the activated pay line L are determined in the lottery process of S12 for each of the variable display portions 22, 23, 24 based on the random number values sampled through the random number sampling circuit 56. Here, all symbols stopped and displayed on the activated pay line L in the variable display portions 22, 23, 24 may be determined based on the random number value sampled through the random number sampling circuit 56. In order to accomplish this, a lottery table of the winning symbol combinations shown in FIG. 13 is used. FIG. 13 is an explanatory view showing a lottery table of the winning symbol combinations and payouts thereof.

In FIG. 13, a random number value range used in the lottery table of the winning symbol combinations is set in a range of 0~1270, and the random number value sampled through the random number sampling circuit 56 lies in a range of 0~22, the winning symbol combination "7-7-72 is won and the payout of "100" is obtained. Similarly, each of the payouts of "5", "3", "2", "1" is determined based on the table shown in FIG. 13.

Here, if the random number value sampled lies in a range of 248~1279, the game is lost. In this case, although the symbol combination other than the winning symbol combinations is stopped and displayed on the activated pay line L in each of the variable display portions 22, 23, 24, no coin is paid out.

In the slot machine 1 of the embodiment, although only the base game is played, for example, a free game may be played right after the process of S13 in FIG. 7 after the base game is conducted. In the free game, games benefiting the player are generally conducted, and for example, when the free game occurs based on a condition that a specific symbol is stopped and displayed, games are continuously conducted for 10 games, 20 games or 30 games according to a rank of the free game. At that time, in the free game, a winning probability to win various winning symbol combinations is generally set high, therefore the player can obtain many coins.

In the slot machine 1 of the embodiment, if it is determined that the ceiling value symbol combination, or threshold target value, is won (S44: YES), coins corresponding to the preset payout are paid out based on the tables shown in FIG. 11 (S45). Here, as the payout, instead of coins, the free game mentioned in the above may be conducted in a preset continuous number of times.

Further, although the slot machine 1 of the embodiment is constructed as a mechanical reel type slot machine in which the symbols formed on the peripheries of the reels 220 controlled to rotate are variably displayed and stopped through the variable display portions 22 to 24, the slot machine 1 may be constructed as a video reel type slot machine in which the image symbols are variably displayed and stopped in each of the variable display portions 22 to 24.

Figure 14:
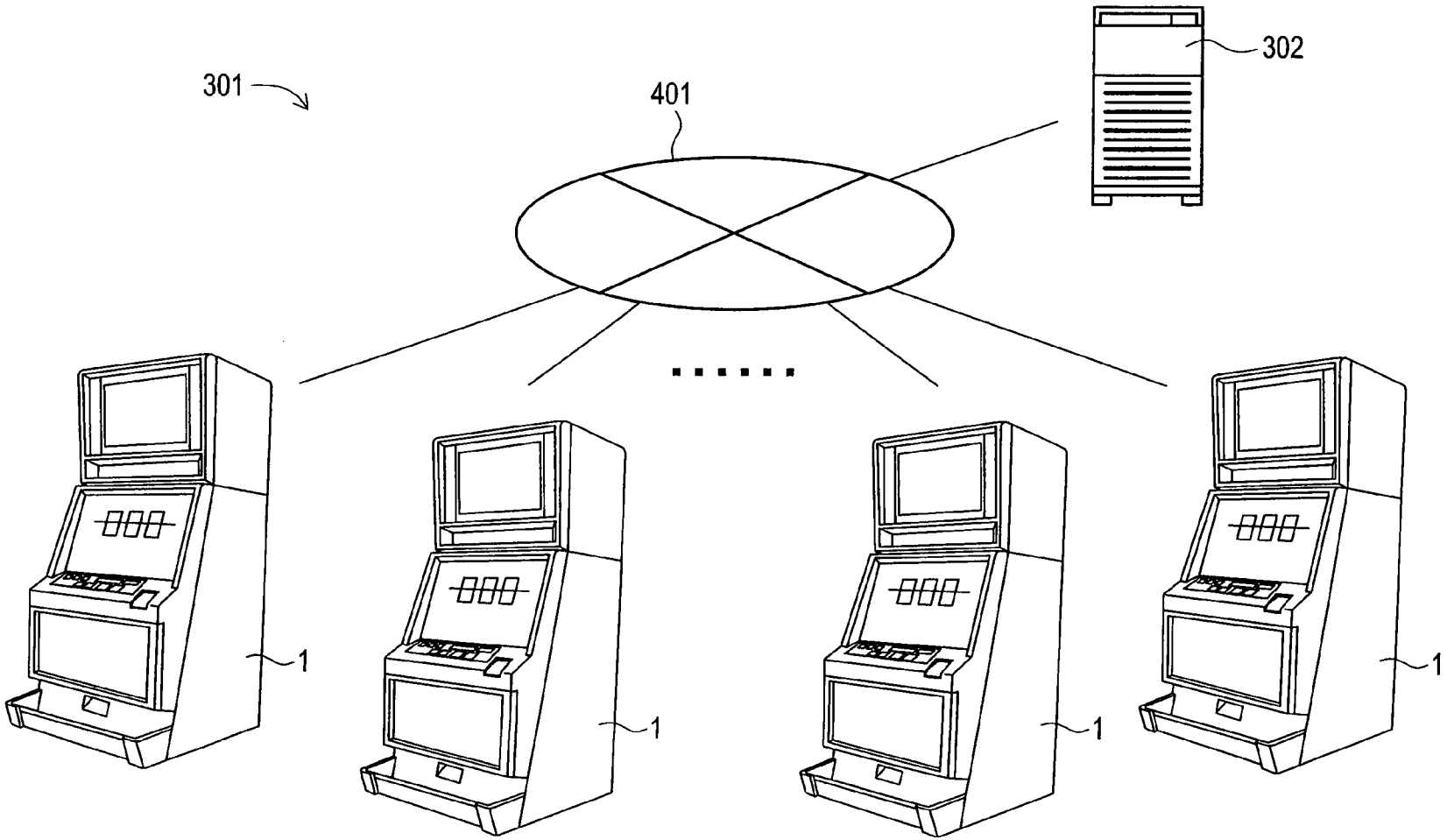
FIG. 14 is a system block diagram showing a slot system.
Figure 15:
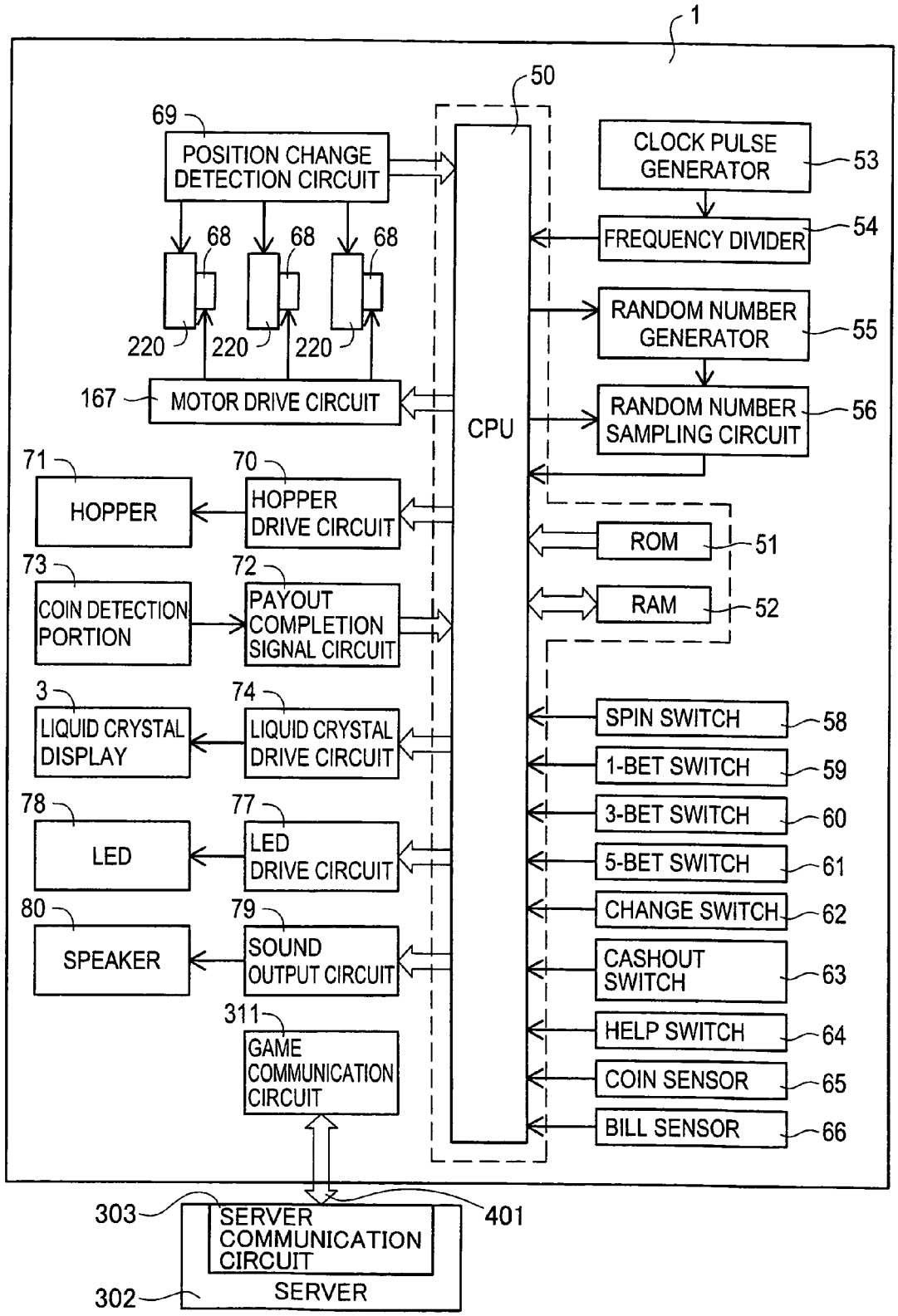
FIG. 15 is a block diagram schematically showing a control system of the slot machine constructing the slot system.
Figure 16:
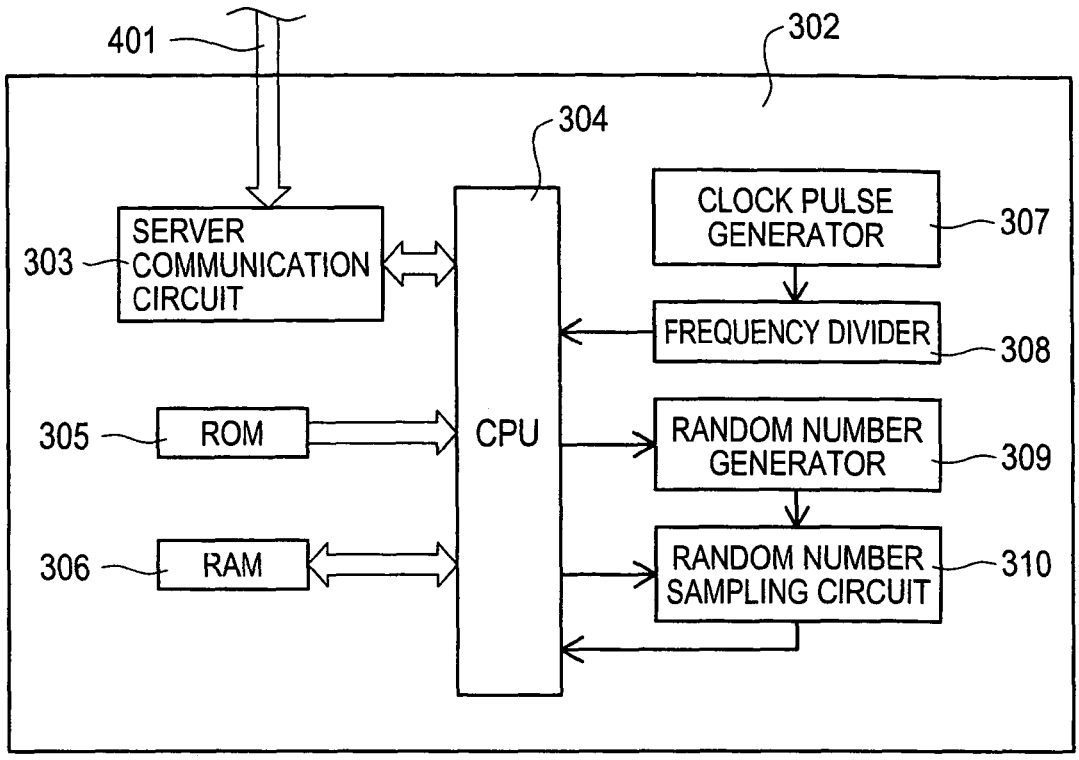
FIG. 16 is a block diagram schematically showing a control system of a server constructing the slot system.

Next, a gaming system of the present invention will be described according to the embodiment embodying the present invention in a slot system, with reference to the drawings. At first, an outline construction of a slot system according to the embodiment will be described with reference to FIGS. 14~16. FIG. 14 is a system block diagram showing a slot system of the embodiment. FIG. 15 is a block diagram schematically showing a control system of the slot machine constructing the slot system of the embodiment. FIG. 16 is a block diagram schematically showing a server control system of the slot system according to the embodiment.

Here, the slot machine constructing the slot system of the embodiment is the same as that of the slot machine shown in FIGS. 1 and 2, except for a difference in construction mentioned hereinafter. Thus, hereinafter, the elements that are the same as those in the slot machine already mentioned above, the same marks (numbers) are used as in the above slot machine and explanation thereof will be omitted. Further, the slot machine 1 shown in FIGS. 1 and 2 is the same as the slot machine used in the slot system, thus hereinafter the number "1" is used for the slot machine in the slot system.

As shown in FIG. 14, in a slot system 301 according to the embodiment, a server 302 and a plurality of slot machines 1 are mutually connected through a network 401 with bilateral communication ability.

In each of the slot machines 1, a game communication circuit 311 is connected to the CPU 50 as shown in FIG. 15. The game communication circuit 311 converts a signal sent by the slot machine 1 into a communicable signal corresponding to a communication used by a telephone network or a LAN cable. The game communication circuit 311 sends such signal to the server 302, receives the signal sent from the server 302 and reconverts the signal so that the slot machine 1 can read it. The game communication circuit 311 is connected to the server 302 through a server communication circuit 303 and the network 401 with bilateral communication ability, such as, the Internet.

Further, as shown in FIG. 16, a control system of the server 302 is basically constructed from a CPU 304. A ROM 305 and a RAM 306 are connected to the CPU 304. A Jack Pot and ceiling value symbol combination, or threshold target value, execution process program, a lottery table for the number of times the game must be played to start the ceiling value symbol combination, or threshold target value, the table shown in FIG. 11 which is the table for starting the ceiling value symbol combination, or threshold target value, and effect notification, and other various programs necessary to control the server 302 and data tables are stored in the ROM 35. The RAM 306 is a memory that temporarily stores various data calculated by the CPU 304.

A clock pulse generator 307 for generating standard clock pulses and a frequency divider 308 are connected to the CPU 304. A random number generator 309 for generating random numbers and a random number sampling circuit 310 are connected to the CPU 304. The random number sampled through the random number sampling circuit 310 is used in various lotteries such as Jack Pot ceiling value symbol combination, or threshold target value.

The server communication circuit 303 is connected to the CPU 304. Here, the server communication circuit 303 converts a signal sent by the server 302 into a communicable signal corresponding to a communication used by a telephone network or LAN cable. The server communication circuit 303 sends such signal to each of the slot machines 1, receives the signal sent from the slot machine 1 and reconverts the signal so that the server 302 can read it. The server communication circuit 303 is connected to each slot machine 1 through the game communication circuit 303 of each slot machine 1 and the network 401 with bilateral communication ability, such as, the Internet.

Figure 17:
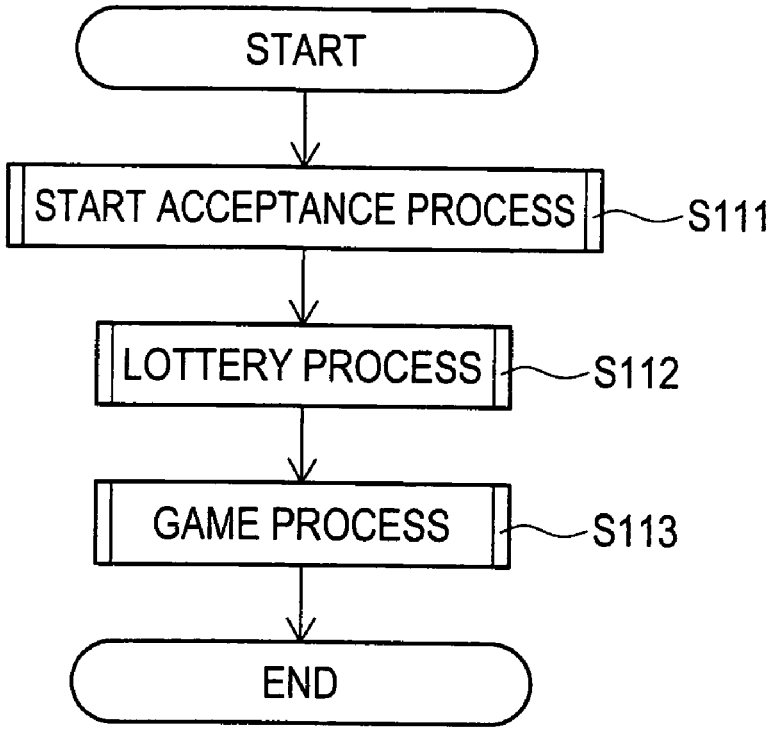
FIG. 17 is a flowchart of a main process program conducted in each slot machine of the slot system.

Next, a main process program executed in each of the slot machines 1 of the slot system 301 will be described with reference to FIG. 17. FIG. 17 is a flowchart of the main process program. Here, processes in S111~S113 of FIG. 17 are as same as the processes in S11~S13 of FIG. 7, therefore the explanation thereof will be omitted.

Figure 18:
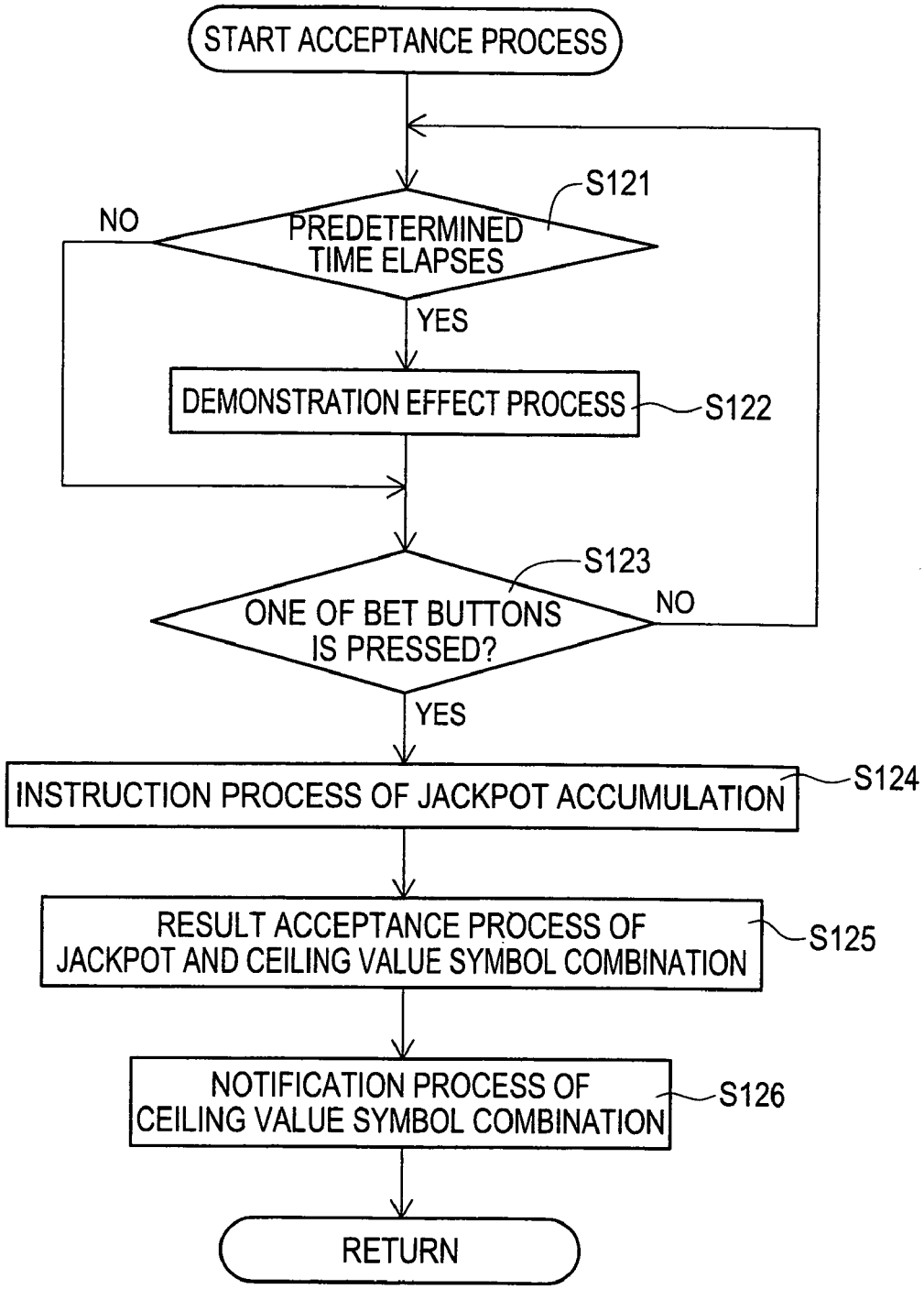
FIG. 18 is a flowchart of a start acceptance program conducted in each slot machine of the slot system.

Next, a start acceptance process program conducted in each slot machine 1 of the slot system 301 will be described with reference to FIG. 18. FIG. 18 is a flowchart of the start acceptance process program. The start acceptance process is conducted in S111 of the main process program in FIG. 17. In this start acceptance process in S111, at first, processes of S121~S123 in FIG. 18 are sequentially conducted. Here, the processes in S121 ~S123 are the same as those in S21~S23, thus the explanation thereof will be omitted.

Therefore, when the HELP button 8 is pressed during the game, the total number of times N the game has been played is displayed on the liquid crystal display 3. Here, the total number of times N the game has been played is a total number obtained in the server 302 by adding the number of times of the game has been played in each of the slot machines 1. Thus, if the HELP button 8 is pressed during the game, it is displayed on the liquid crystal display 3 the total number of times N the game has been played (total number of the game conducted in each of the slot machines 1 in the slot system 301) which is updated and received from the server 302 at that timing.

In S124, a Jack Pot accumulation instruction process is conducted, and the slot machine 1 sends an instruction (including information of number of coins bet) to add a part of coins bet (worth equivalent thereto) in the slot machine 1 to the progressive Jack Pot and individual information of the slot machine 1 are sent to the server 302. Thereafter, the procedure shifts to S125.

In S125, a Jack Pot and ceiling value symbol combination, or threshold target value, result acceptance process is conducted. Thereby, the slot machine 1 receives information indicating that the Jack Pot or the ceiling value symbol combination, or threshold target value, is won, a value of the progressive Jack Pot, the total number of times N the game has been played and three numbers of times the game must be played to start the ceiling value symbol combination, or threshold target value, from the server 302.

Further, in S126, the process to notify the ceiling value symbol combination is conducted. In this process, when the total number of times N the game has been played reaches a predetermined number of times the game has been played that is smaller than the value determined as the number of times the game must be played to start the ceiling value symbol combination, or threshold target value, the player is thereafter notified after each game is conducted, that the payout for the ceiling value symbol combination, or threshold target value, is given, by displaying the tables shown in FIG. 11 on the liquid crystal display 3. Concretely, for example, in a case that three numbers of times the game must be played to start the ceiling value symbol combination, or threshold target value, which are received in the process to notify the ceiling value symbol combination, or threshold target value, of S125, are respectively "700", "200", "600", when the total number of times N the game has been played becomes "190" which is smaller than "200" by "10", the tables shown in FIG. 11 are displayed on the liquid crystal display 3 every the total number of times N the game has been played is received till the total number of times N the game has been played reaches to "200". And when the total number of times N the game has been played becomes "570" which is smaller than "600" by "30", the tables shown in FIG. 11 are displayed on the liquid crystal display 3 every the total number of times N the game has been played is received till the total number of times N the game has been played reaches to "600". Further, when the total number of times N the game has been played becomes "650" which is smaller than "700" by "50", the tables shown in FIG. 11 are displayed on the liquid crystal display 3 every the total number of times N the game has been played is received till the total number of times N the game has been played reaches to "700".

Thereafter, the procedure returns to the main process program of FIG. 17 and shifts to the lottery process in S112.

Figure 19:
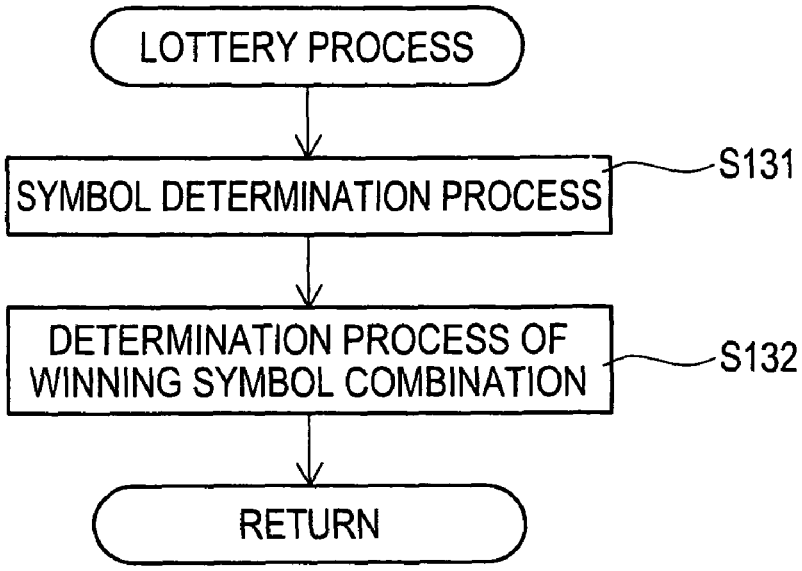
FIG. 19 is a flowchart of a lottery process program conducted in each slot machine of the slot system.

Next, the lottery process program conducted in each slot machine 1 of the slot system 301 will be described with reference to FIG. 19. FIG. 19 is a flowchart of the lottery process program. In S112 of the main process program in FIG. 17, the lottery process is conducted. At that time, at first, processes of S131 and S132 in FIG. 19 are conducted. Here, the processes of S131 and S132 are as same as those of the processes of S31 and S32, thus the explanation thereof will be omitted.

Figure 20:
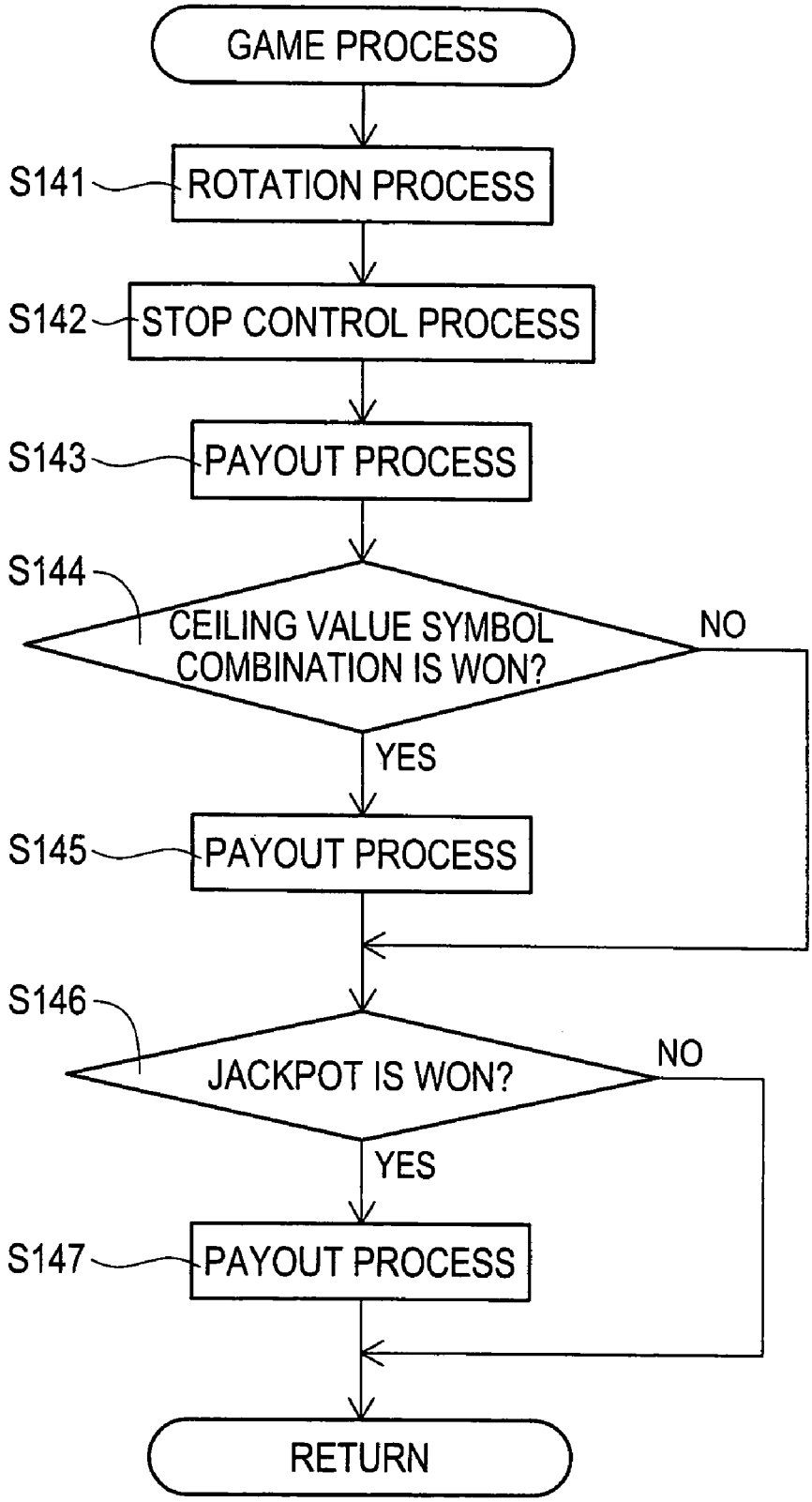
FIG. 20 is a flowchart of a game process program conducted in each slot machine of the slot system.

Next, a game process program performed in each slot machine 1 of the slot system 301 will be described with reference to FIG. 20. FIG. 20 is a flowchart of the game process program. Here, in S113 of the main process program in FIG. 17, the game process is conducted. At that time, at first, each of processes in S141 ~S143 is sequentially conducted. Here, the processes in S141~S143 are the same as those in S41~S43 of FIG. 10, thus the explanation thereof will be omitted.

In S144, it is determined whether or not the ceiling value symbol combination, or threshold target value, is won. This determination is done based on whether or not it is received from the server 302 in S125 of FIG. 18 the information indicating that the ceiling value symbol combination, or threshold target value, is won. Here, if it is determined that the ceiling value symbol combination, or threshold target value, is not won (S144: NO), the procedure shifts to S146. On the other hand, if it is determined that the ceiling value symbol combination, or threshold target value, is won (S144: YES), coins (for example, 500 coins) corresponding to the preset payout based on the tables in FIG. 11 are paid out in S145. Thereafter, the procedure shifts to S146.

In S146, it is determined whether or not the Jack Pot is won. This determination is done based on whether or not it is received from the server 302 in S125 of FIG. 18 the information indicating that the Jack Pot is won. Instead of this, for example, it may be determined that the Jack Pot is won only if the winning symbol combination "7-7-7" is won in S112 of FIG. 17.

In S146, if it is determined that the Jack Pot is not won (S146: NO), the main process program of FIG. 17 is terminated, thereafter the main process program of FIG. 17 is newly started. On the other hand, if it is determined that the Jack Pot is won (S146: YES), coins corresponding to the value of the progressive Jack Pot received from the server 302 in S125 of FIG. 18 are paid out. Thereafter, the main process program of FIG. 17 is terminated, and the main process program of FIG. 17 is newly started.

Figure 21:
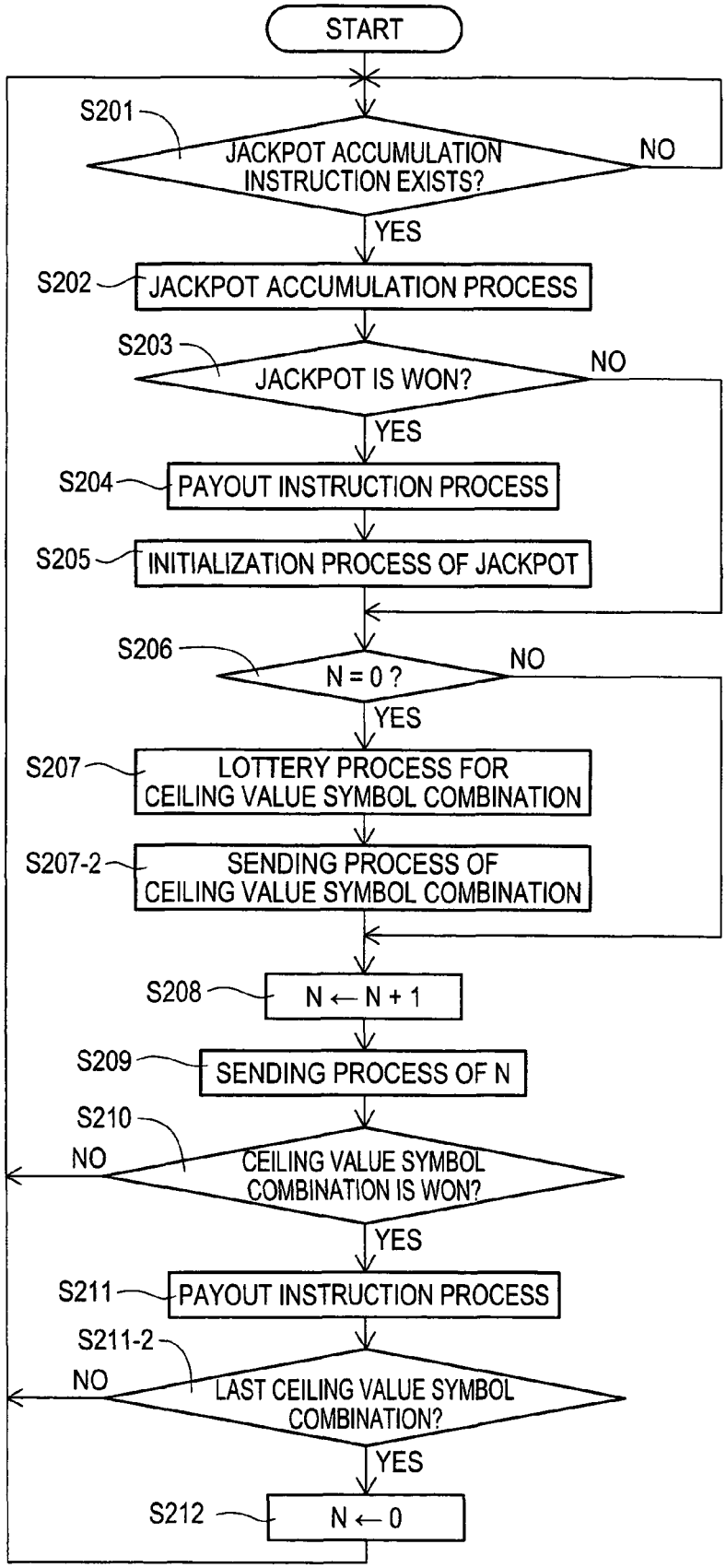
FIG. 21 is a flowchart of a lottery process program for Jack Pot and ceiling value symbol combination, the program being conducted in the server of the slot system.

Next, a Jack Pot and ceiling value symbol combination, or threshold target value, lottery process, which is conducted in the server 302 of the slot system 301, will be described with reference to FIG. 21. FIG. 21 is a flowchart of the Jack Pot and ceiling value symbol combination, or threshold target value, lottery process. In FIG. 21, at first, it is determined whether or not the Jack Pot accumulation instruction exists in S201. This determination is done based on whether or not it has received the instruction (including information of number of coins bet), which is sent from any of the slot machines 1 in S124 of FIG. 18, to add a portion of coins (worth equivalent thereto) bet to the progressive Jack Pot.

Here, if it is determined that the Jack Pot accumulation instruction does not exist (S201: NO), the procedure returns to S201 itself and waits until the Jack Pot accumulation instruction occurs. On the other hand, if it is determined that the Jack Pot accumulation instruction exists (S201: YES), the procedure shifts to a Jack Pot accumulation process in S202 and a portion (equivalent worth) of coins received is added to the progressive Jack Pot. Here, the progressive Jack Pot is stored in a memory area of the RAM 306.

In S203, it is determined whether or not the Jack Pot is won. In this determination, it is determined that the Jack Pot is won only in a case that the random number value sampled within a range of 0~1023 through the random number sampling circuit 310 is "0". Here, if it is determined that the Jack Pot is not won (S203: NO), the procedure shifts to S206. On the other hand, if it is determined that the Jack Pot is won (S203: YES), the procedure shifts to S204. In a payout instruction process of S204, the information indicating that the Jack Pot is won and the value of the progressive Jack Pot accumulated up to now is sent to the slot machine 1, which is a sender of the instruction received by the server 302. Then in an initialization process of the Jack Pot in S205, "0" is substituted for the progressive Jack Pot, thereby the progressive Jack Pot is reset.

Thereafter, the procedure shifts to S206 and it is determined whether or not the total number of times N the game has been played is "0". Here, if it is determined that the total number of times N the game has been played is not "0" (S206: NO), the procedure shifts to S208. On the other hand, if it is determined that the total number of times N the game has been played is "0" (S206: YES), the procedure shifts to S208 after a ceiling value symbol combination, or threshold target value, lottery process is conducted.

The ceiling value symbol combination, or threshold target value, lottery process in S207 will be described. In the lottery process for ceiling value symbol combination, or threshold target value, in S207, three random number values are sampled within a range of 0~127 through the random number sampling circuit 310, and three numbers of times the game must be played to start the ceiling symbol combination, or threshold target value, are respectively determined based on the three tables shown in FIG. 11. Concretely speaking, if the first random number value sampled through the random number sampling circuit 310 lies in a range of 0~25, "100" is determined as the number of times the game must be played to start the ceiling value symbol combination, or threshold target value, based on the upper table in FIG. 11. If the second random number value sampled through the random number sampling circuit 310 lies in a range of 26~63, "500" is determined as the number of times the game must be played to start the ceiling value symbol combination, or threshold target value, based on the middle table in FIG. 11. Further, if the third random number value sampled through the random number sampling circuit 310 lies in a range of 64~127, "900" is determined as the number of times the game must be played to start the ceiling value symbol combination, or threshold target value, based on the lower table in FIG. 11. That is to say, three values of the number of times the game must be played to start the ceiling value symbol combination, or threshold target value, are determined in the lottery process for the ceiling value symbol combination, or threshold target value, in S207.

The ceiling value symbol combination, or threshold target value, is a symbol combination through which a payout is given when the total number of times N the game has been played reaches the value determined as the number of times the game must be played to start the ceiling value symbol combination, or threshold target value. For example, in the lottery process for the ceiling value symbol combination, or threshold target value, in S207, if three of the number of times the game must be played to start the ceiling value symbol combination, or threshold target value, each of which is determined based on each of three tables in FIG. 11, are respectively "400", "800", "300", every the total number of times N the game has been played becomes "300", "400" and "800", the payout of "500" is given.

However, as mentioned, the total number of times N the game has been played is the total number of times obtained by adding the number of times the game has been played in each of the slot machines 1 of the slot system 301. Therefore, it will be probable that the slot machine 1 can obtain the payout of the ceiling value symbol combination, or threshold target value, if the total number of times N the game has been played counted by the server 302 becomes any one of "100", "200", "300", "400", "500", "600", "700", "800", "900" when the game is conducted in such slot machine 1. Here, the tables shown in FIG. 11 are stored in the ROM 305 and the total number of times N the game has been played is stored in a memory area of the RAM 306.

In the lottery process for the ceiling value symbol combination, or threshold target value, in S207, the lottery of plural numbers of times the game must be played to start the ceiling value symbol combination, or threshold target value, may be conducted beforehand through the random number sampling circuit 310. Thereafter, three of the number of times the game must be played to start the ceiling value symbol combination, or threshold target value, may be determined by a lottery among such plural numbers of times the game must be played to start the ceiling value symbol combination, or threshold target value. Here, in this case, the lottery done beforehand may be conducted right before three of the number of times the game must be played to start the ceiling value symbol combination, or threshold target value, are determined within the lottery process for the ceiling value symbol combination, or threshold target value, of S207, or for example, may be conducted when the total number of times N the game has been played is reset in S212 mentioned later by substituting the number N for "0".

In S207-2, three numbers of times the game must be played to start the ceiling value symbol combination, or threshold target value, determined in S207 are sent to the slot machine which a sender of the instruction received by the server 302 in S201.

Further, in S208, "1" is added to the total number of times N the game has been played at present, thereby the total number of times N the game has been played in the present game is calculated. And in S209, the total number of times N the game has been played in the present game is sent to the slot machine which is a sender of the instruction received by the server 302 in S201.

In S210, it is determined whether or not the ceiling value symbol combination, or threshold target value, is won. This determination is done whether or not the total number of times N the game has been played is calculated in S208 to coincide with any of three numbers of times the game must be played to start the ceiling value symbol combination, or threshold target value, determined in S207. If it is determined that the ceiling value symbol combination, or threshold target value, is not won (S210: NO), the procedure returns to S201 and processes mentioned in the above are repeated. On the other hand, if it is determined that the ceiling value symbol combination, or threshold target value, is won (S210: YES), the procedure shifts to S211. In a payout instruction process of S211, the information indicating that the ceiling value symbol combination, or threshold target value, is won is sent to the slot machine 1 which is a sender of the instruction received by the server 302 in S201. Further, in S211-2, it is determined whether or not the ceiling value symbol combination, or threshold target value, won in S210 is the last ceiling value symbol combination, or threshold target value. This determination is done based on whether or not the total number of times N the game has been played is calculated in S208 to be the maximum number of times the game must be played to start the ceiling symbol combination, or threshold target value, among three numbers of times the game must be played to start the ceiling symbol combination, or threshold target value, determined in S207. Here, if it is determined that the ceiling value symbol combination, or threshold target value, is not the last ceiling value symbol combination, or threshold target value, (S211-2: NO), the procedure returns to S201. On the other hand, if it is determined that the ceiling value symbol combination, or threshold target value, is the last ceiling value symbol combination, or threshold target value, (S211-2: YES), "0" is substituted for the total number of times N the game has been played in S212, thereby the total number of times N the game has been played is reset. Thereafter, the procedure returns to S201 and the processes mentioned above are repeated.

As mentioned in detail above, in the slot system 301 of the embodiment, a portion of the coins (worth equivalent thereto) bet in the slot machine 1 are added to the progressive Jack Pot in the server 302 (S207). Thereafter, if it is determined that the progressive Jack Pot is won (S47: YES), coins (for example, 10000 coins) corresponding to the progressive Jack Pot accumulated up to this point are paid out in the slot machine 1 (S204, S147). Here, as a condition to win the progressive Jack Pot, it is limited to a case that the random number value sampled within a range of 0~1023 through the random number sampling circuit 310 is "0" in the server 302. Therefore, in many cases, the progressive Jack Pot becomes enormous, thus although the possibility of winning a Jack Pot is given to a player, on the contrary, even if the player continues to play games while aiming for the progressive Jack Pot, there will rarely be a case that the player will obtain the progressive Jack Pot. Therefore, the player generally gives up from the start from attempting to obtain the progressive Jack Pot.

However, in the slot system 301 of the embodiment, three numbers of times the game must be played to start the ceiling value symbol combination, or threshold target value, are determined (S207) based on the lottery using three random number values sampled within a range of 0~127 through the random number sampling circuit 310 and three tables of FIG. 11, and coins corresponding to the preset payout, are paid out (S211, S145) based on the tables in FIG. 11, every time the total number of times N the game has been played reaches each of three numbers of times the game must be played to start the ceiling symbol combination, or threshold target value (S210). Thereby, if the player continues to play a maximum of 900 slot games to aim for the ceiling value symbol combination, or threshold target value, the player can surely win the ceiling value symbol combination, or threshold target value, in three times. Therefore, even if the player gives up trying to obtain the progressive Jack Pot, a portion of the coins (worth equivalent thereto) bet is accumulated every game, and therefore the interest of the player to continue the slot games can be sufficiently maintained.

Here, the payout corresponding to the ceiling value symbol combination, or threshold target value, may be set to the same value shown in FIG. 11 with no relation to the number of times the game must be played to start the ceiling value symbol combination, or threshold target value. The payout corresponding to the ceiling value symbol combination, or threshold target value, may be set different according to the number times of the game must be played necessary to start the ceiling value symbol combination, or threshold target value.

In the slot system 301 of the embodiment, after the total number of times N the game has been played reaches the predetermined number that is smaller than the value determined as the number of times the game must be played to start the ceiling value symbol combination, or threshold target value, the player is notified thereafter (S28), in each slot machine 1, after every game is conducted, that the payout corresponding to the ceiling value symbol combination, or threshold target value, is given, by displaying the tables shown in FIG. 11 on the liquid crystal display 3.

Therefore, for example, it is clear to the player that if the notification is not started after the total number of times N the game has been played becomes "90", the ceiling value symbol combination, or threshold target value, cannot be won even if the total number of times N the game has been played becomes "100" and the ceiling value symbol combination, or threshold target value, can be won after the total number of times N the game has been played becomes more than "200". It is clear that if the notification is not started after the total number of times N the game has been played becomes "190", the ceiling value symbol combination, or threshold target value, cannot be won even if the total number of times N the game has been played becomes "200" and the ceiling value symbol combination, or threshold target value, can be won after the total number of times N the game has been played becomes more than "300". Further, it is clear that if the notification is not started after the total number of times N the game has been played becomes "290", the ceiling value symbol combination, or threshold target value, cannot be won even if the total number of times N the game has been played becomes "300" and the ceiling value symbol combination, or threshold target value, can be won after the total number of times N the game has been played becomes more than "400". Similarly to the above, if the effect notification is not started after the total number of times N the game has been played becomes "370", "470", "570", "650", "750" or "850", it is clear for the player that the same situations as the above occurs. Therefore, since an index to win the ceiling value symbol combination, or threshold target value, is provided, the interest of the player to continue the slot games can be sufficiently maintained.

Here, the manner of the effect notification corresponding to the number of times the game must be played to start the ceiling value symbol combination, or threshold target value, are described as an example, thus it is not limited to this. For example, when the tables shown in FIG. 11 are displayed on the liquid crystal display 3, it may be displayed the difference between the total number of times N the game has been played at present and the number of times the game must be played to start the ceiling value symbol combination, or threshold target value, which is the nearest to the number N.

In the slot system 301 of the embodiment, the total number of times N the game has been played, calculated by the server 302, is calculated on the basis of the games (which are calculation object) conducted in each of the slot machines 1. Thus, the total number of times N the game has been played reaches to "100", "500", "1000", rapidly in comparison with a case where the number of times the game has been played in independent slot machine 1 becomes the calculation object. Therefore, interest of the player to continue the slot games can be sufficiently maintained.

Here, the present invention is not limited to the embodiment and various changes, modifications can be done within the scope of the present invention.

For example, in the slot system 301 of the embodiment, although there are three numbers of times the game must be played to start the ceiling value symbol combination, or threshold target value, which are determined (S207) by using three tables shown in FIG. 11 in which plural numbers of times the game must be played to start the ceiling value symbol combination, or threshold target value, are provided, one table may be used in which many numbers of times the game must be played to start the ceiling value symbol combination, or threshold target value, are provided. The number of times the game must be played to start the ceiling value symbol combination, or threshold target value, may be set to only one, number. The number of times the game must be played to start the ceiling value symbol combination, or threshold target value, may be determined (S207), based on one table shown in FIG. 12.

In the slot system 301 of the embodiment, when the HELP button 8 is pressed in each slot machine 1 during the game, the total number of times N the game has been played is displayed on the liquid crystal display 3. Here, the total number of times N the game has been played may not be displayed. In this case, the player does not know the number of times N the game has been played and may think that coins corresponding to the payout of the ceiling value symbol combination, or threshold target value, will suddenly be paid out. Therefore, the player expects sudden payout of coins, and the interest of the player to continue to play the slot games can be sufficiently maintained.

In the slot system 301 of the embodiment, although the value determined as the number of times the game must be played to start the ceiling value symbol combination, or threshold target value, corresponds to the total number of times N the game has been played, such value may instead correspond to the value of the progressive Jack Pot with a specific manner such as "1111", "2222", . . . , "9999", "1000", "2000", . . . , "9000". However, in this case, coins paid out for the ceiling value symbol combination, or threshold target value, are subtracted from the progressive Jack Pot.

In each slot machine 1 of the slot system 301 according to the embodiment, the symbols stopped and displayed on the activated pay line L are determined in the lottery process of S112 for each of the variable display portions 22, 23, 24 based on the random number values sampled through the random number sampling circuit 56. Here, all symbols stopped and displayed on the activated pay line L in the variable display portions 22, 23, 24 may be determined based on the random number value sampled through the random number sampling circuit 56. In order to achieve this, a lottery table of the winning symbol combinations shown in FIG. 13 is used. Here, since explanation of FIG. 13 is already described in the above, the explanation thereof will be omitted.

In each slot machine 1 of the slot system 301 according to the embodiment, although the base game is performed, for example, a free game may be performed right after the process of S113 in FIG. 17 after the base game is conducted. In the free game, games beneficial for the player are generally conducted, and for example, when the free game occurs based on a condition that a specific symbol is stopped and displayed, games are continuously conducted for 10 games, 20 games or 30 games according to a rank of the free game. At that time, in the free game, a winning probability to win various winning symbol combinations is generally set high, therefore the player can obtain many coins.

In the slot system 301 of the embodiment, if it is determined that the ceiling value symbol combination, or threshold target value, is won (S210: YES), coins corresponding to the preset payout are paid out based on the tables shown in FIG. 11 (S211, S143). Here, as the payout, instead of coins, the free game mentioned in the above may be performed in a continuous number of preset times.

Further, although each slot machine 1 of the slot system 301 according to the embodiment is constructed as a mechanical reel type slot machine in which the symbols formed on the peripheries of the reels 220 controlled to rotate are variably displayed and stopped through the variable display portions 22 to 24, the slot machine 1 may be constructed as a video reel type slot machine in which the image symbols are variably displayed and stopped in each of the variable display portions 22 to 24.

In the slot system 301 of the embodiment, it is determined whether or not both of the Jack Pot and ceiling value symbol combination, or threshold target value, are won (S203, S210). Here, it may be independently determined in each slot machine 1 whether or not the ceiling value symbol combination, or threshold target value, is won, including calculation of the total number of times N the game has been played, or it may be independently determined in each slot machine 1 whether or not the progressive Jack Pot is won, including calculation of the value of the progressive Jack Pot.

And in the slot system 301 of the embodiment, although the server 302 different from the slot machine 1 constructs a part of the system, the function of the server 302 may be charged by any of the slot machines 1 and the server 302 may be excluded.

The present invention can be adopted for technology of a gaming machine in which the progressive Jack Pot is utilized.

What is claimed is:

1. A gaming machine comprising:

a display device for variably displaying and stopping symbols during a game;

a memory storing a lottery table, the lottery table having interrelated random number ranges, threshold target values and payouts corresponding to each of said random number ranges, each threshold target value being defined as an accumulatively counted number of times the game has been played; and a processor programmed to operate with the display device and the memory (a) to extract a random number, (b) to determine from the lottery table the random number range to which the random number belongs, (c) to determine the specific threshold target value corresponding to the determined random number range, (d) to accumulatively count a total number of times the game has been played while games are continuously conducted, (e) to determine whether or not the total number of times the game has been played equals the determined specific threshold target value, and (f) to determine from the lottery table and cause the display device to display the related payout and provide the payout to the player when the total number of times the game has been played equals with the determined specific threshold target value.

2. The gaming machine according to claim 1, wherein the memory includes plural lottery tables, wherein the processor respectively determines one threshold target value from each of the lottery tables, and wherein the processor gives the related payout each occurrence that the total number of times the game has been played reaches one of the determined threshold target values.

3. The gaming machine according to claim 2, wherein the processor determines a last-in-sequence threshold target value among the determined threshold target values of the plural lottery tables, wherein the processor determines whether or not the total number of times the game has been played equals with the last-in-sequence threshold target value, and wherein the processor resets the total number of times the game has been played when the total number of times the game has been played equals the last-in-sequence threshold target value.

4. The gaming machine according to claim 1, wherein the processor starts notification indicating that the related payout will be given when the total number of times the game has been played reaches a predetermined value smaller than the determined threshold target value.

5. A gaming system in which plural gaming machine and a server are connected, each of the gaming machines comprising;

a display device for variably displaying and stopping symbols during a game; and a gaming machine processor programmed to operate with the display device (a) to conduct a lottery to determine a stop display manner of the symbols on the display device, (b) to control the display device to stop the symbols according to the stop display manner, and (c) to provide a payout based on the stop display manner of the symbols;

the server comprising:

a memory storing a lottery table, the lottery table having interrelated random number ranges, threshold target values and payouts corresponding to each of said random number ranges, each threshold target value being defined as an accumulatively counted number of times the game has been played and a server processor programmed:

(d) to extract a random number (e) to determined from the lottery table the random number range to which the random number belongs, (f) to determine the threshold target value corresponding to the determined random number range, (g) to accumulatively count-up a total number of times the game has been played while the games are continuously conducted in the gaming machine, (h) to determined whether or not the total number of times the game has been played equals the determined threshold target value, and (i) to determine from the lottery table and give the related payout to the gaming machine when the total number of times the game has been played equals the determined threshold target value.

6. The gaming system according to claim 5, wherein the memory includes plural lottery tables, wherein the server processor is programmed to determines one threshold target from each of the lottery tables, and wherein the server processor is programmed to provide the related payout to the gaming machine each occurrence that the total number of times the game has been played reaches one the determined threshold target values.

7. The gaming system according to claim 6, wherein the server processor is programmed to determines a last-in-sequence threshold target value among the determined threshold target values of the plural lottery tables, wherein the server processor is programmed to determines whether or not the total number of times the game has been played equals the last-in-sequence threshold target value, and wherein the server processor is programmed to resets the total number of times the game has been played when the total number of times the game has been played equals the last-in-sequence threshold target value.

8. The gaming system according to claim 5, wherein the gaming machine processor is programmed to starts notification indicating that the related payout will be given when the total number of times the game has been played reaches a predetermined value smaller than the determined threshold target value.

* * * * *